US009341422B2

(12) United States Patent
Rodich et al.

(10) Patent No.: US 9,341,422 B2
(45) Date of Patent: May 17, 2016

(54) ARCHERY BOW

(71) Applicant: NXT GENERATION, LLC, Akron, OH (US)

(72) Inventors: Rudy D. Rodich, Aurora, OH (US); Joe G. Box, Twinsburg, OH (US)

(73) Assignee: NXT Generation, LLC, Akron, OH (US)

( * ) Notice: Subject to any disclaimer, the term of this patent is extended or adjusted under 35 U.S.C. 154(b) by 0 days.

(21) Appl. No.: 14/621,862

(22) Filed: Feb. 13, 2015

(65) Prior Publication Data

US 2015/0233667 A1 Aug. 20, 2015

Related U.S. Application Data

(60) Provisional application No. 61/940,025, filed on Feb. 14, 2014.

(51) Int. Cl.

| | |
|---|---|
| ***F41B 5/00*** | (2006.01) |
| ***F41A 9/73*** | (2006.01) |
| ***F41B 11/89*** | (2013.01) |
| ***F41B 11/54*** | (2013.01) |
| ***F41B 11/643*** | (2013.01) |

(52) U.S. Cl.
CPC ... *F41A 9/73* (2013.01); *F41B 5/00* (2013.01); *F41B 11/54* (2013.01); *F41B 11/643* (2013.01); *F41B 11/89* (2013.01)

(58) Field of Classification Search
CPC ..... F41B 5/1484; F41B 5/066
USPC ..... 124/25.6, 25.7, 23.1, 66, 67, 86, 24.1
See application file for complete search history.

(56) References Cited

U.S. PATENT DOCUMENTS

| | | | | |
|---|---|---|---|---|
| 2,069,821 | A * | 2/1937 | Douglas | F41B 11/00 124/24.1 |
| 3,017,874 | A * | 1/1962 | Gubash | F41B 5/066 124/25.7 |
| 4,146,009 | A * | 3/1979 | Adams | F41B 5/10 124/41.1 |
| 4,869,226 | A * | 9/1989 | Wu | F41B 5/143 124/25.7 |
| 5,107,819 | A * | 4/1992 | Pugh | F41B 5/1438 124/25.7 |
| 5,224,464 | A * | 7/1993 | Burnham | F41B 7/00 124/16 |
| 5,327,877 | A * | 7/1994 | Shaw, III | F41B 5/143 124/24.1 |
| 5,515,837 | A | 5/1996 | Nin et al. | |
| 5,605,140 | A | 2/1997 | Griffin | |
| 5,701,878 | A | 12/1997 | Moore et al. | |
| 5,737,001 | A | 4/1998 | Ma | |

(Continued)

*Primary Examiner* — Reginald Tillman, Jr.
(74) *Attorney, Agent, or Firm* — Rankin, Hill & Clark LLP

(57) ABSTRACT

An archery bow for selectively firing multiple projectiles one at a time and having riser with first and second ends and limb arrangements fixed relative thereto with a bow string is joined therebetween, the bow having a drum housing and a selectively rotatable drum rotatably secured relative to the housing, the drum being rotatable about a drum axis and having a projectile openings circumferentially spaced about the drum axis, each of the projectile openings shaped to receive a projectile wherein a plurality of projectiles can be secured in the drum at one time, one of the projectile openings being in a firing position and supporting a projectile to be fired by the bow, the remaining projectile openings being spaced from the firing position to reduce interference with the projectile to be fired, the drum having a rotation mechanism to rotate each of openings into the firing position individually, the bow further including a shooting force mechanism to selectively propel the projectiles.

19 Claims, 19 Drawing Sheets

(56) References Cited

U.S. PATENT DOCUMENTS

| | | | | |
|---|---|---|---|---|
| 6,997,770 | B2 * | 2/2006 | Lapointe | F41B 11/00 124/66 |
| 7,882,829 | B2 | 2/2011 | Witzigreuter | |
| 8,057,309 | B1 | 11/2011 | Mead et al. | |
| 8,087,405 | B2 * | 1/2012 | Mitchell | F41B 11/646 124/56 |
| 8,387,605 | B2 | 3/2013 | Brown et al. | |
| 8,402,958 | B2 | 3/2013 | Victor et al. | |
| 8,596,254 | B2 | 12/2013 | Brooks et al. | |
| D741,439 | S * | 10/2015 | Rodich | D21/571 |
| 2006/0046877 | A1 | 3/2006 | Gajda, Jr. | |
| 2010/0147277 | A1 | 6/2010 | Zimmerman et al. | |
| 2011/0041821 | A1 | 2/2011 | Brown et al. | |
| 2012/0125307 | A1 | 5/2012 | Bromley et al. | |
| 2013/0298891 | A1 * | 11/2013 | Romney | F41A 21/10 124/66 |

* cited by examiner

ARCHERY BOW

This application claims priority to provisional patent application Ser. No. 61/940,025 filed on Feb. 14, 2014, which is incorporated by reference herein.

The invention of this application relates in general to an archery bow and, more particularly, to a bow that can shoot multiple projectiles. While it has been found that the invention of this application works well in connection with toy bows, it can be used in connection with a wide range of bows including an adult archery bow. However, in the interest of brevity, it is being discussed in this application primarily in connection with toy bows.

BACKGROUND OF THE INVENTION

Archery bows have been around for a long time and come in many forms. Archery bows essentially started as simple structures that included a string attached to a long shaft and the bending of the shaft produced the energy needed for the string to propel an arrow. Over the years, this simple design has been improved to increase shooting speeds, improve accuracy and to reduce holding forces when the bow and arrow are in the shooting position. The advances in the design have resulted in significant improvements of the once simple archery bow. This even included the introduction of the crossbow that combined the function and features of an archery bow with the shooting style of a long gun. However, even with all of the advancements in this industry, archery bows are only configured to hold a single arrow wherein the user must manually load each arrow between shots. As a result, even though the bow and arrow have been improved, the archer must reload his bow between each shot, which greatly reduces the ability to quickly shoot multiple arrows. While the skilled archer can quickly pull arrows from his or her quiver between shots, this still takes time and can take a significant amount of time for the less skilled archer. Therefore, there is a need for a bow that can hold multiple arrows or projectiles wherein the archer can shoot multiple projectiles quickly without reloading the bow.

The same is true with toy bows. While these toy products have been around for many years and have enjoyed many of the same advancements, toy boys also have the same inherent shortcoming wherein they are only capable of holding a single arrow or projectile.

Accordingly, there is a need for a bow that can support more than one arrow and can quickly move the multiple arrows into a firing position without reloading the bow.

For this application, a bow is any bow like structure that can shoot a projectile in a way similar to an archery bow. This can include, but is not limited to, a traditional long bow having a long shaft with a string connected between the ends, a compound bow that includes performance enhancers, a crossbow, and/or any other variation or style known in the archery field or will be known in the field. These bows include toy bows that can shoot a projectile similar to that of a real bow referenced above, but which are used as toys and even youth bows intended for older children and which can shoot more traditional arrows. The projectiles can by any projectile configured to be launched by a bow and which can vary in view of the use of the bow. Further, the projectiles can be newly designed projectiles that are designed to take advantage of the invention of this application. These projectiles can include, but are not limited to, a traditional archery arrow, hunting arrows, non-lethal arrows, target arrows, arrows with modified ends (such as with suction cups or Velcro), foam projectiles (such as those used in NERF products sold by HASBRO. Arrows are a subset of projectiles and can be any arrow like projectile including, but not limited to, traditional archery arrow, hunting arrows, non-lethal arrows, target arrows, arrows with modified ends (such as with suction cups or Velcro), foam arrows, but which directly engage a bow string. And, variations of these examples provided above. These toy bows have been successful over the years and come in a wide variety of configurations. Essentially, these toy bows launch projectiles based on stored energy in a string, air power and/or spring power.

INCORPORATION BY REFERENCE

U.S. Pat. No. 5,515,837 to Nin et al discloses a launch structure for a projectile and is incorporated by reference for showing the same. Published application Pub. No. 2011/0041821 to Brown et al discloses a launch structure for a projectile and is incorporated by reference for showing the same. U.S. Pat. No. 7,882,829 to Witzigreuter discloses a projectile launcher and is incorporated by reference for showing the same. U.S. Pat. No. 7,537,001 to Ma discloses a toy gun for launching a dart and is incorporated by reference for showing the same. Published application Pub. No. 2012/0125307 to Brooks et al discloses a launch structure for a projectile and is incorporated by reference for showing the same. U.S. Pat. No. 8,057,309 to Mead et al discloses a launch structure for a projectile and is incorporated by reference for showing the same. U.S. Pat. No. 5,701,878 to Moore et al discloses a launch structure for a projectile and is incorporated by reference for showing the same. U.S. Pat. No. 5,605,140 to Griffin discloses a launch structure for a projectile and is incorporated by reference for showing the same. Published application Pub. No. 2006/0046877 to Gajda, Jr. discloses foam projectiles and is incorporated by reference for showing the same.

SUMMARY OF THE INVENTION

The invention of this application relates to bows and more particularly to bows that can support more than one projectile and quickly move one of the multiple projectiles into a firing position.

More particularly, the bows of this application include a central rotatable drum that can hold a plurality of projectiles and which can be selectively rotated to position one of the plurality of projectiles into a firing position.

According to one set of aspects of the present invention, provided is a bow that includes a manually rotatable central drum wherein the user rotates the drum to move the projectile into the firing position.

According to another set of aspects of the present invention, provided is a bow that includes a drum that supports the plurality of arrows about a drum axis and wherein the drum rotations the arrows about the drum axis into and out of the firing position, but where the user manually engages the nock of the arrow to the bow string to file the arrow.

According to further aspects of the present invention, provided is a drum that supports at least three projectiles.

According to further yet aspects of the present invention, provided is a drum that supports at least six projectiles.

According to a further set of aspects of the present invention, provided is a drum that is manually rotated about the drum axis wherein the manual rotation is controlled by a ratchet lever.

According to a further set of aspects of the present invention, provided is a drum that has a drum length parallel to the drum axis and the projectile is longer than the drum length wherein the projectile extends outwardly of the rear side of the drum thereby allowing the nock to engage the bow string.

According to yet a further set of aspects of the present invention, provided is a bow that includes a rotatable drum that is rotated when the bow string is drawn back toward full draw.

According to another set of aspects of the present invention, provided is a bow that utilizes the energy produced by the flexing of the bow riser and the movement of the bow string to propel the projectile wherein the bow string is not joined to the rotatable drum.

According to yet another set of aspects of the present invention, provided is a bow that utilizes the bow string to propel the projectile wherein the bow string is operably connected to the rotatable drum.

According to yet further aspects of the present invention, the operable connection between the bow string and the drum at least in part rotations the drum about the drum axis.

According to even yet further aspects of the present invention, the operable connection between the bow string and the drum includes an air cylinder wherein air propels the projectile from the drum.

According to yet other aspects of the present invention, the operable connection between the bow string and the bow includes a force assisting mechanism to increase the shooting force or air flow directed to the projectile.

According to other aspects of the present invention, the force assisting mechanism includes a spring.

These and other objects, aspects, features and advantages of the invention will become apparent to those skilled in the art upon a reading of the Detailed Description of the invention set forth below taken together with the drawings which will be described in the next section.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein.

DESCRIPTION OF PREFERRED EMBODIMENTS

Figure 1:
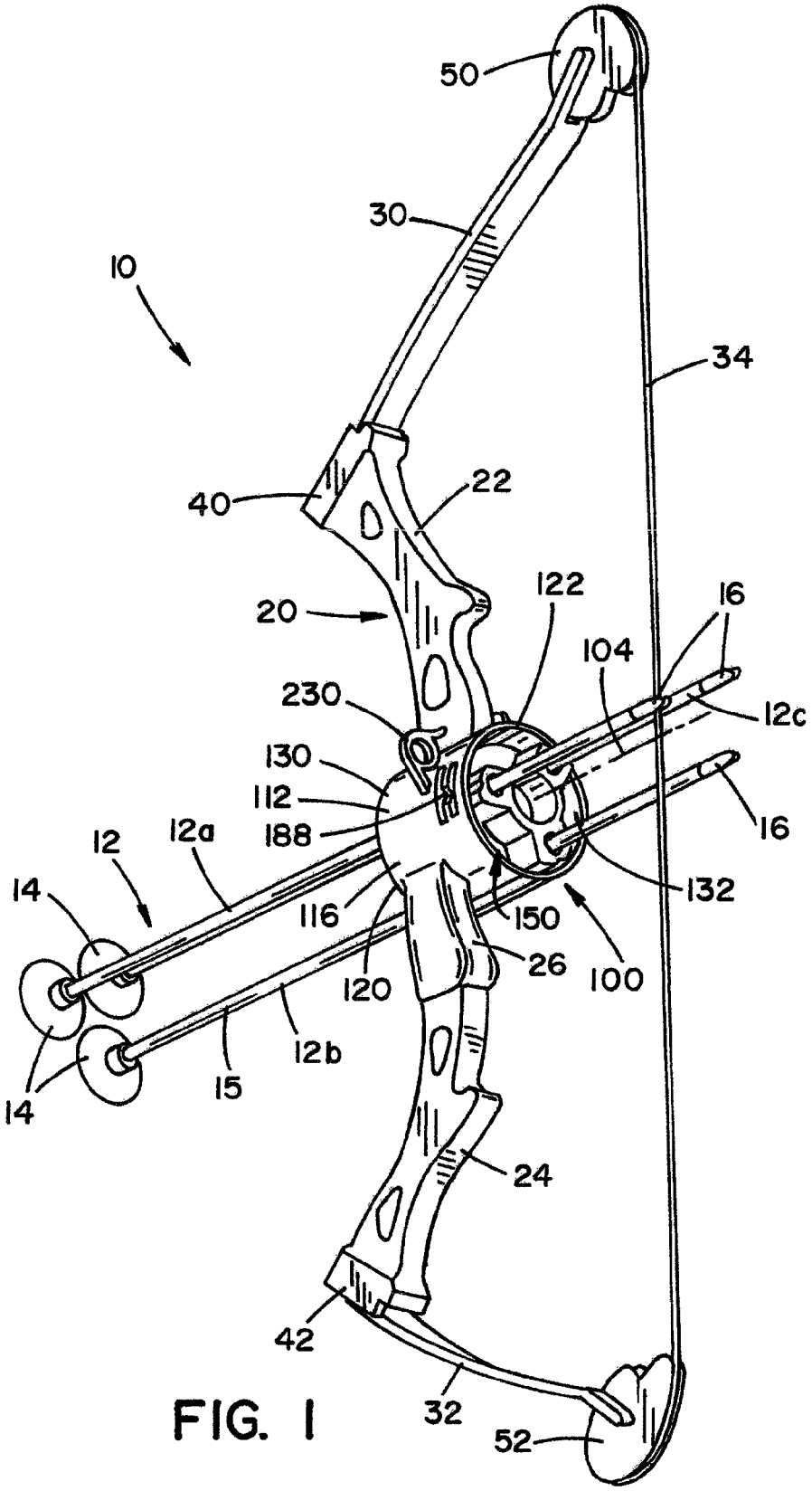
FIG. 1 is a rear perspective view of a bow in accordance with certain aspects of the present invention.
Figure 2:
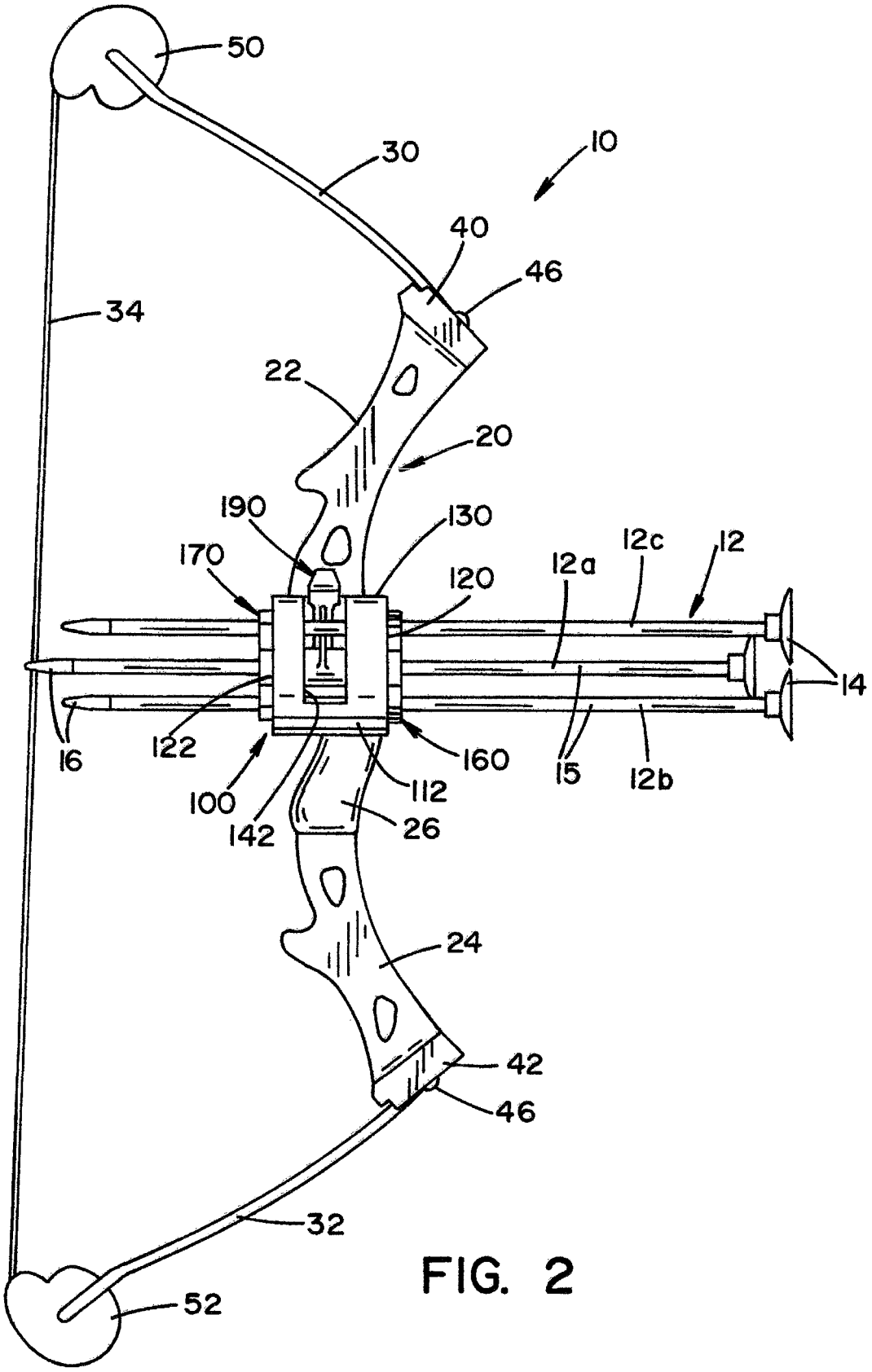
FIG. 2 is a right side elevational view of the bow shown in FIG. 1.
Figure 3:
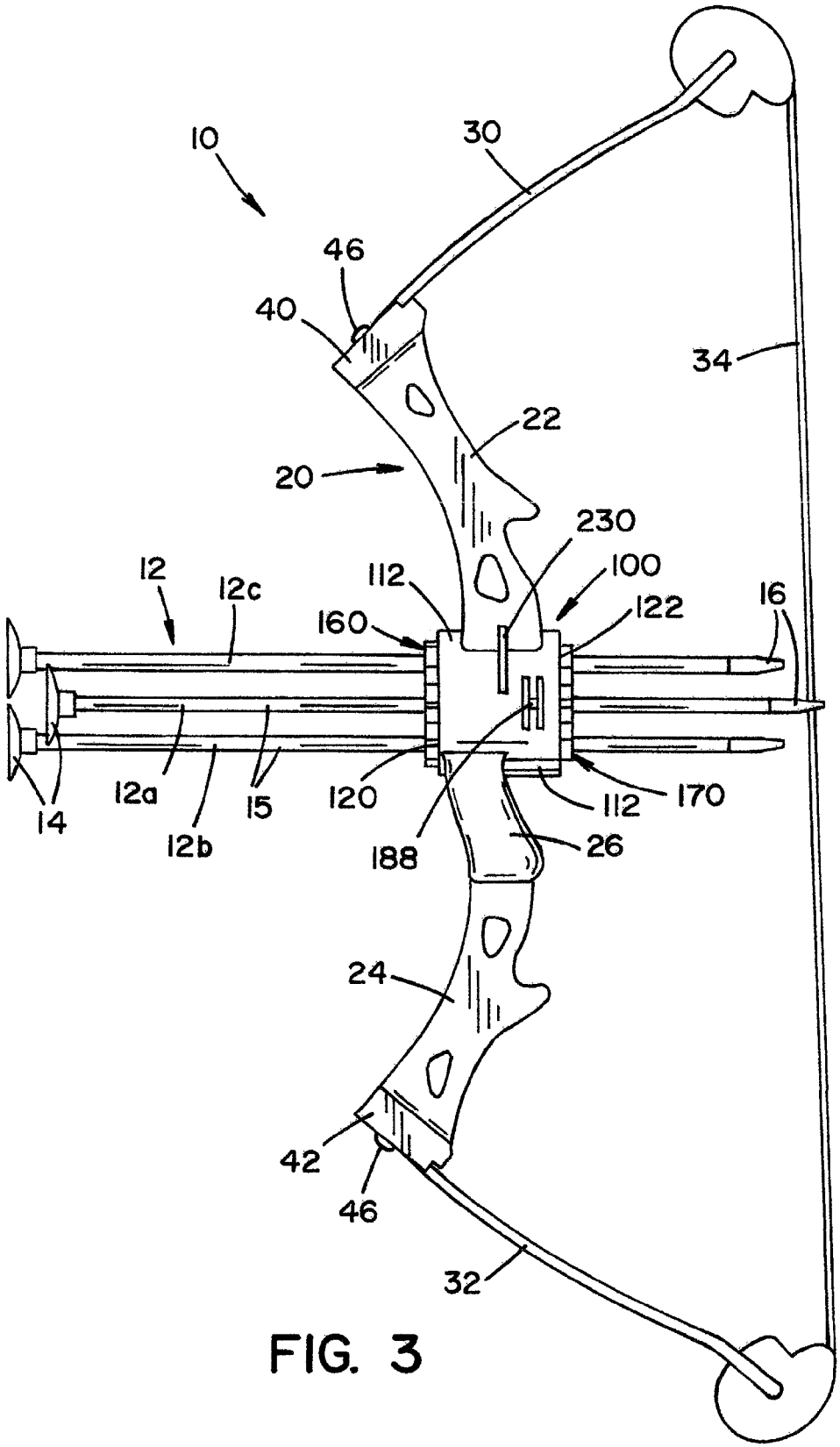
FIG. 3 is a left side elevational view of the bow shown in FIG. 1.
Figure 4:
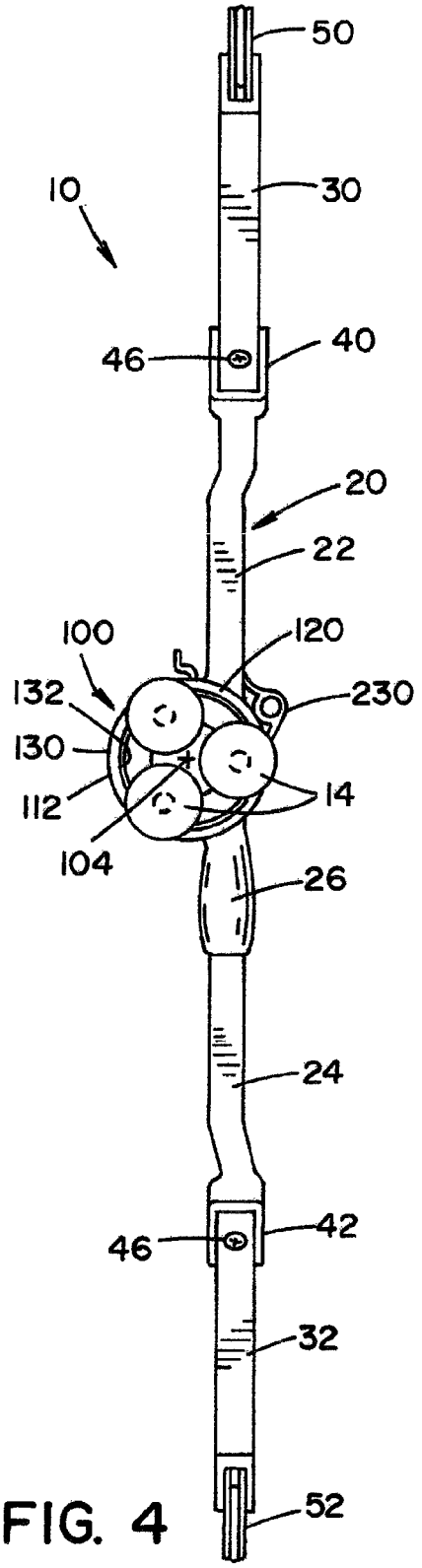
FIG. 4 is a front elevational view of the bow shown in FIG. 1.
Figure 5:
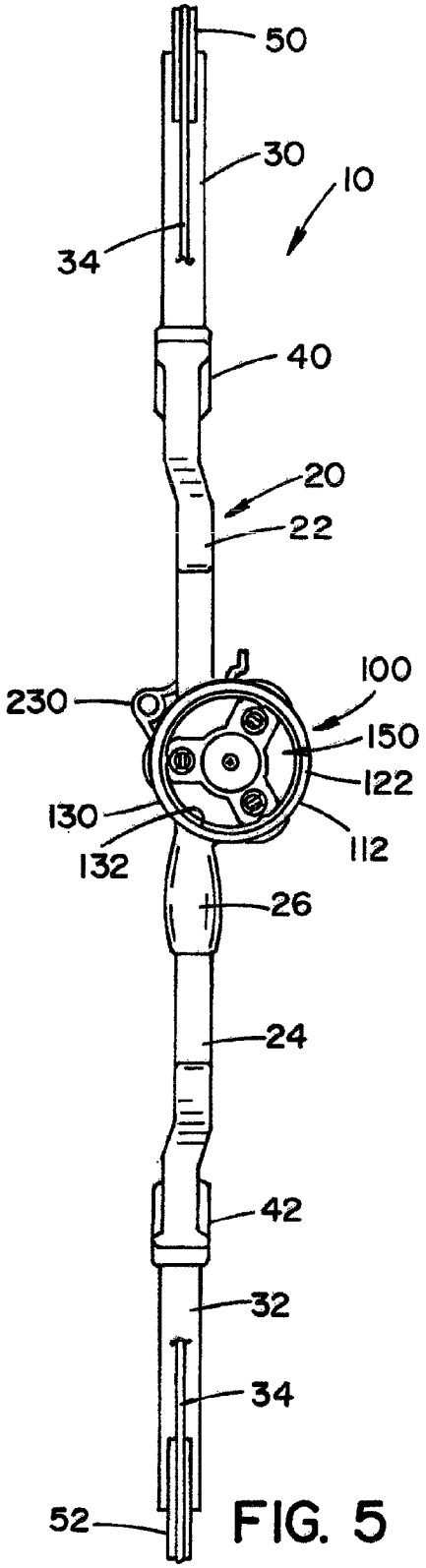
FIG. 5 is a rear elevational view of the bow shown in FIG. 1.
Figure 6:
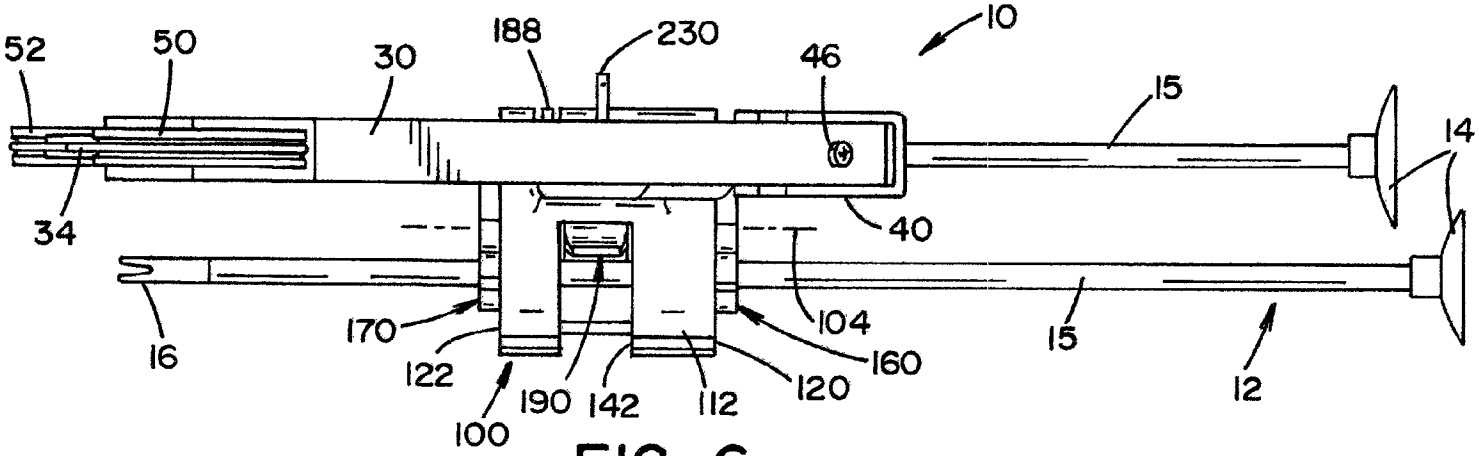
FIG. 6 is a top view of the bow shown in FIG. 1.
Figure 7:
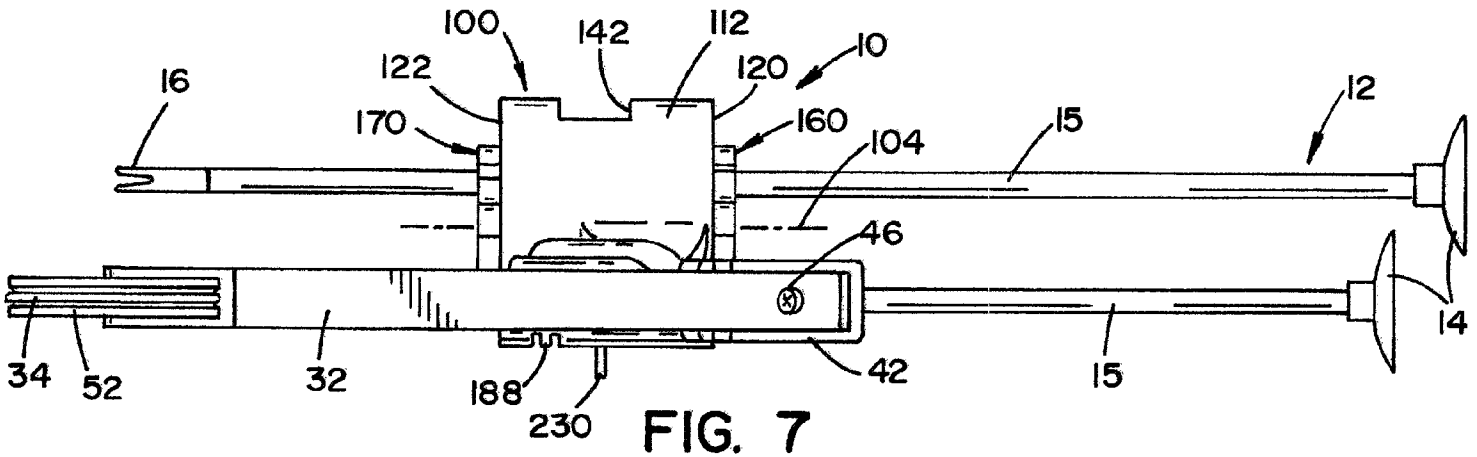
FIG. 7 is a bottom view of the bow shown in FIG. 1.
Figure 8:
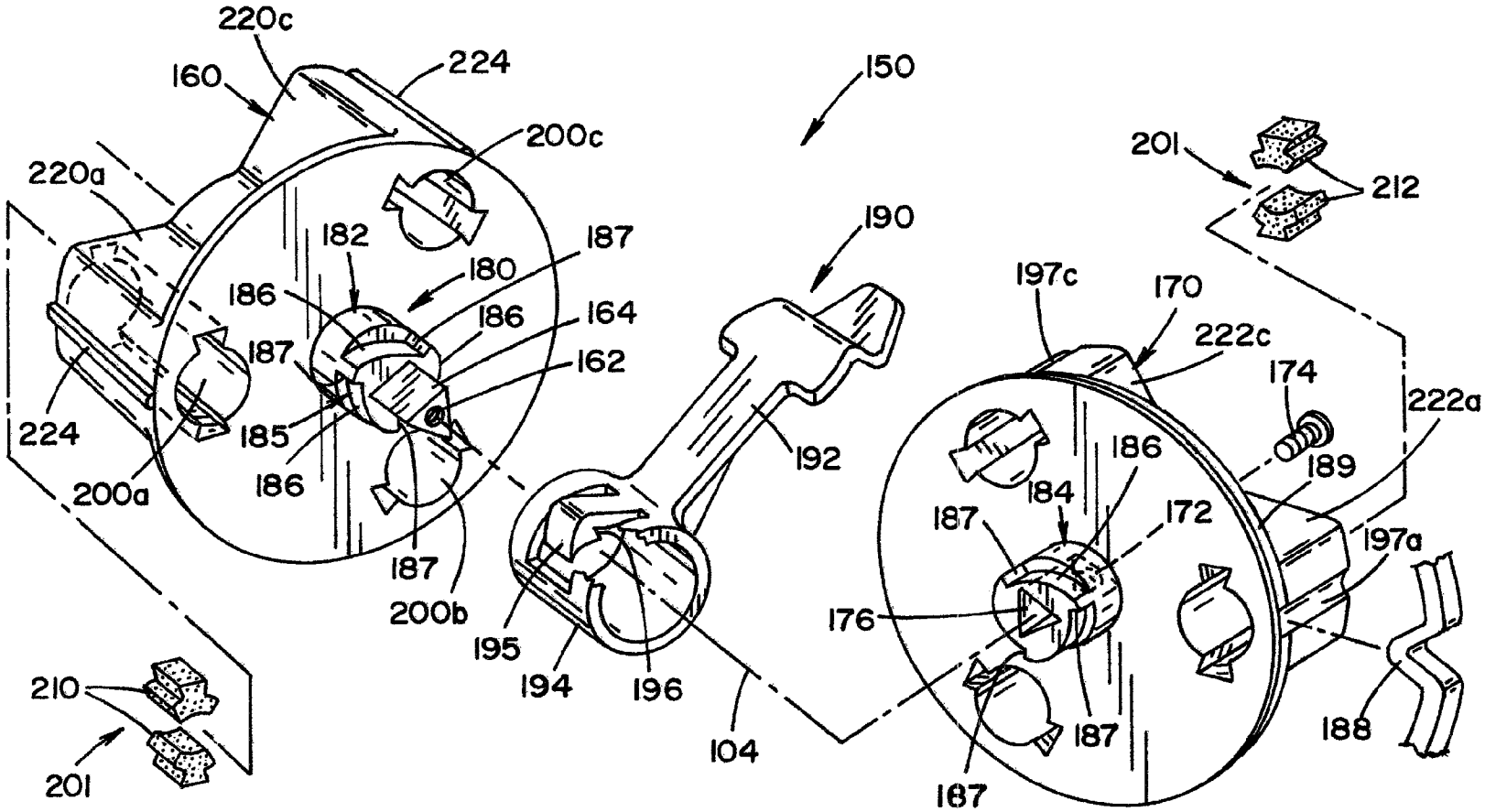
FIG. 8 is an exploded perspective view of a drum assembly from the bow shown in FIG. 1.
Figure 9:
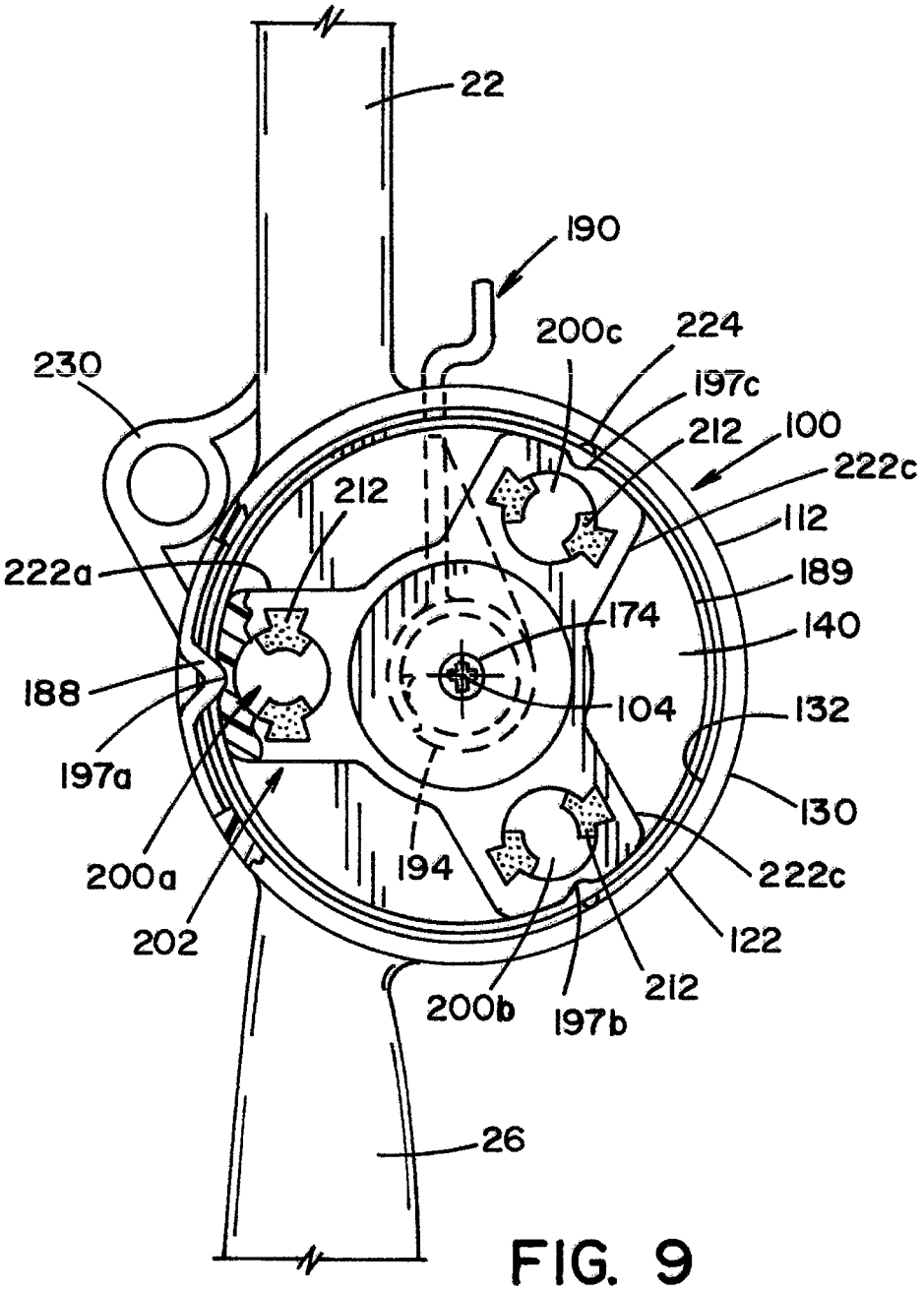
FIG. 9 is an enlarged partial rear elevational view of a drum housing and the drum assembly, partially sectioned, of the bow shown in FIG. 1.
Figure 10:
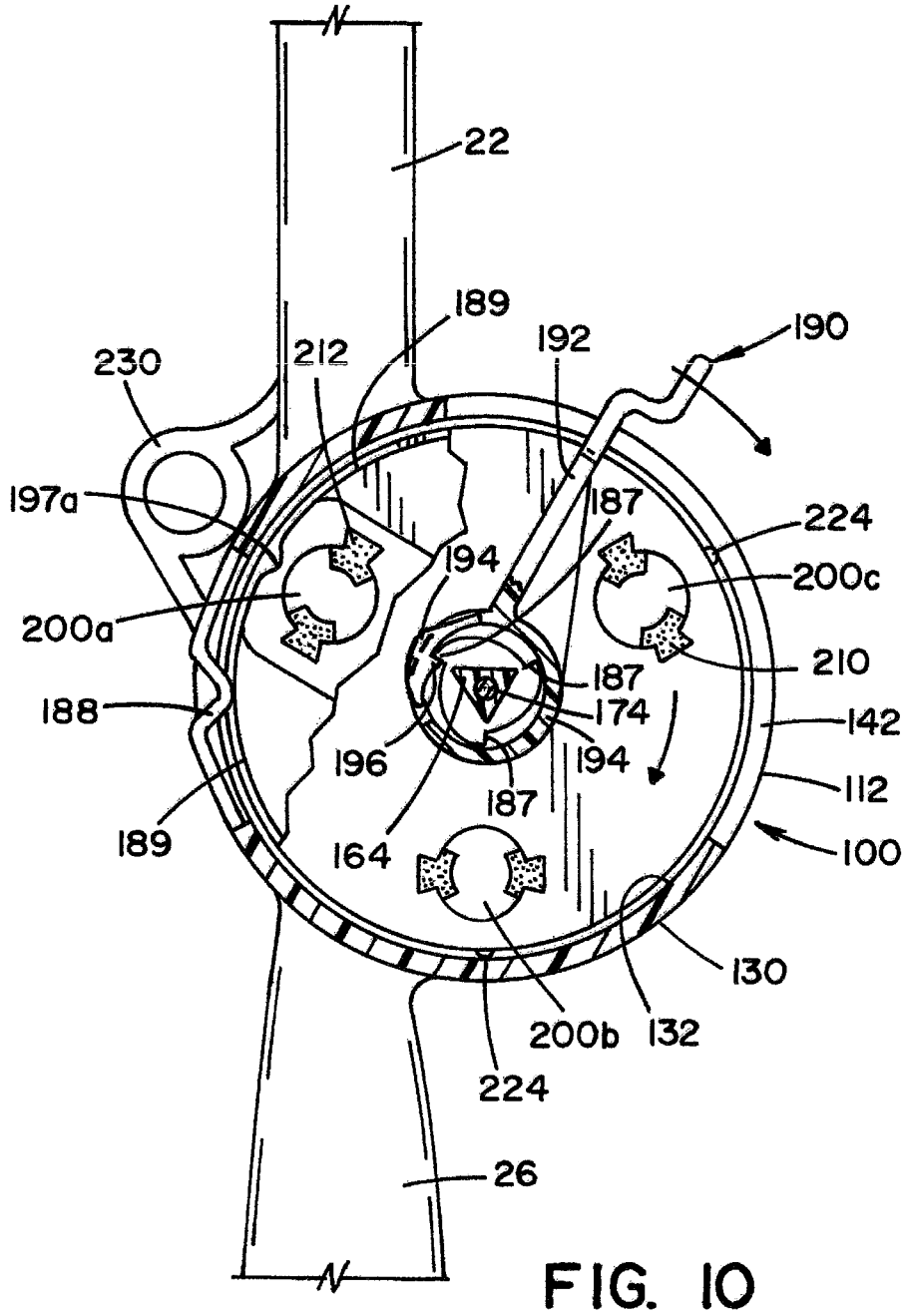
FIG. 10 is an enlarged partial rear elevational view of the drum housing and the drum assembly, partially sectioned, of the bow shown in FIG. 1.
Figure 11:
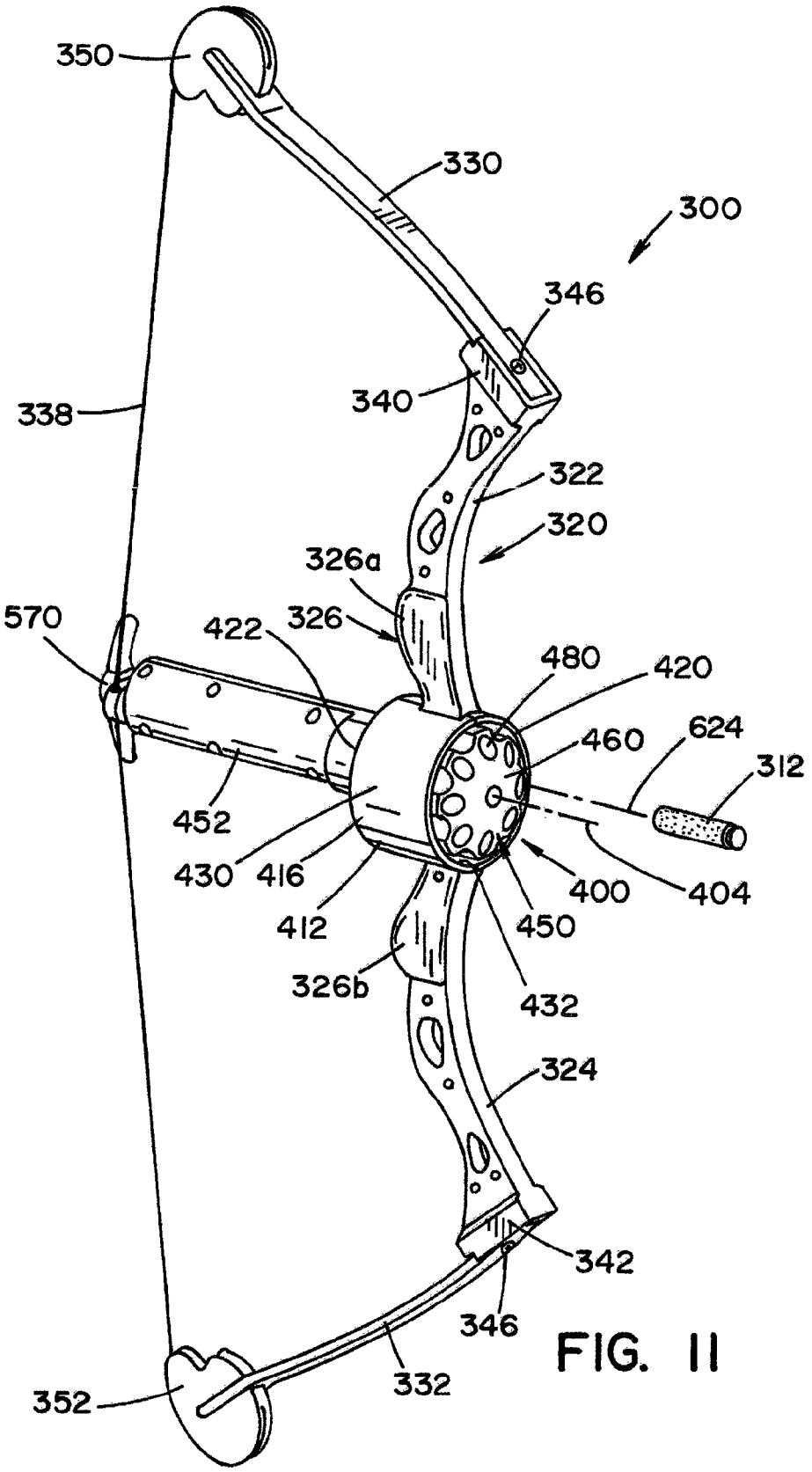
FIG. 11 is a front perspective view of a bow in accordance with another set of embodiments of the invention of this application.
Figure 12:
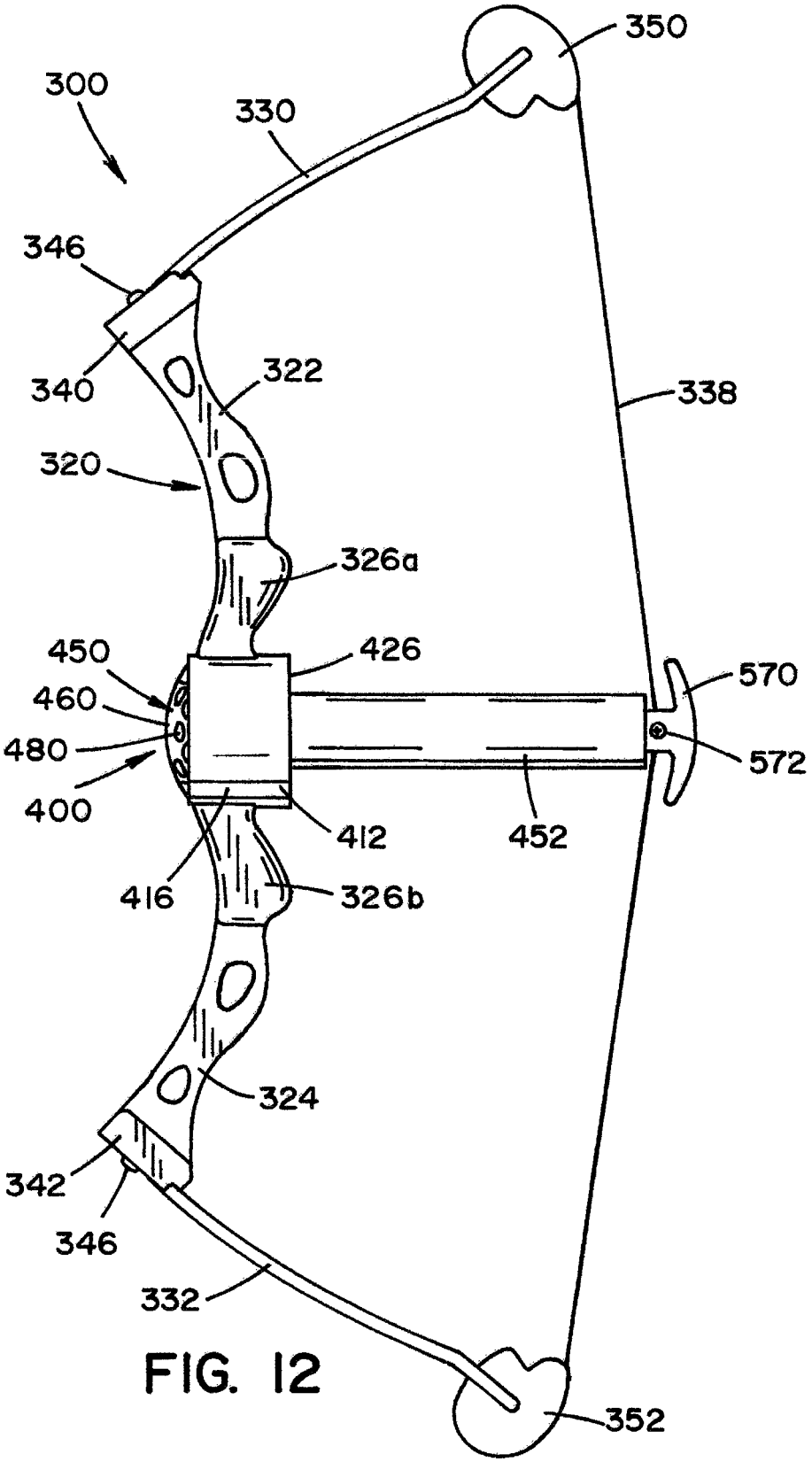
FIG. 12 is a left side elevational view of the bow shown in FIG. 11.
Figure 13:
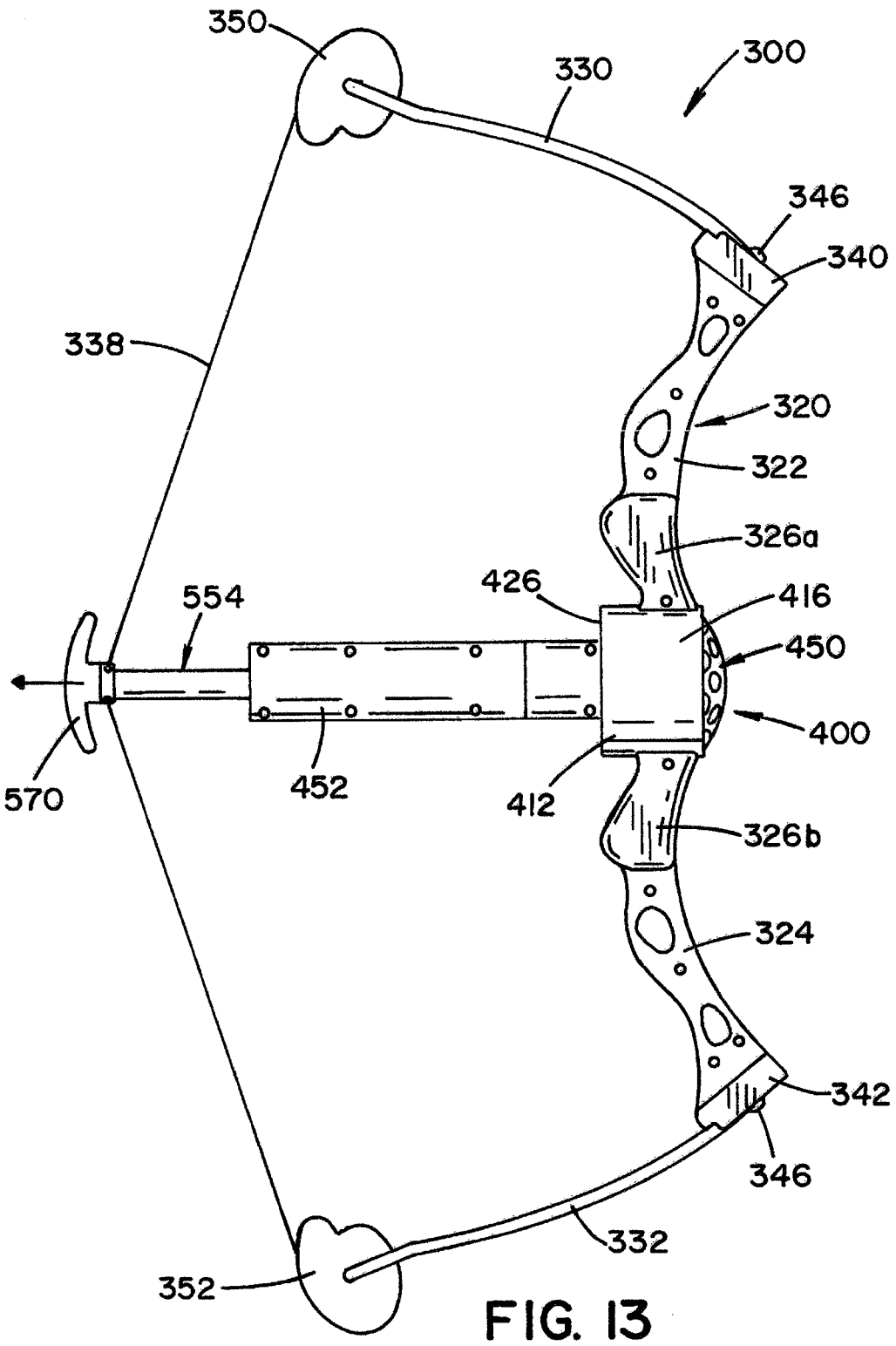
FIG. 13 is a right side elevational view of the bow shown in FIG. 11.
Figure 14:
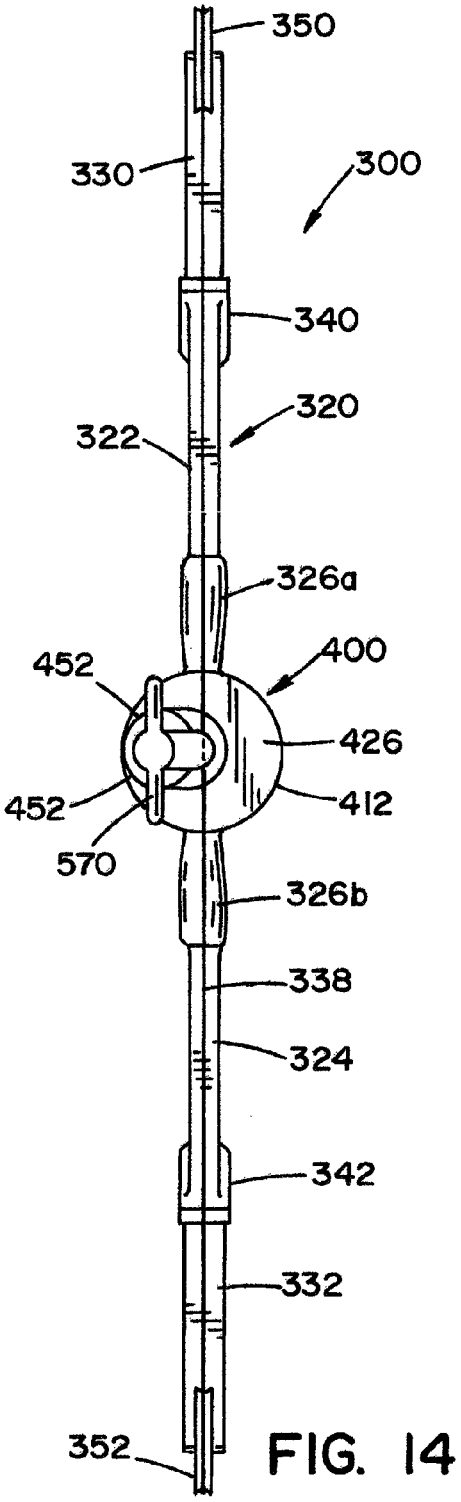
FIG. 14 is a rear elevational view of the bow shown in FIG. 11.
Figure 15:
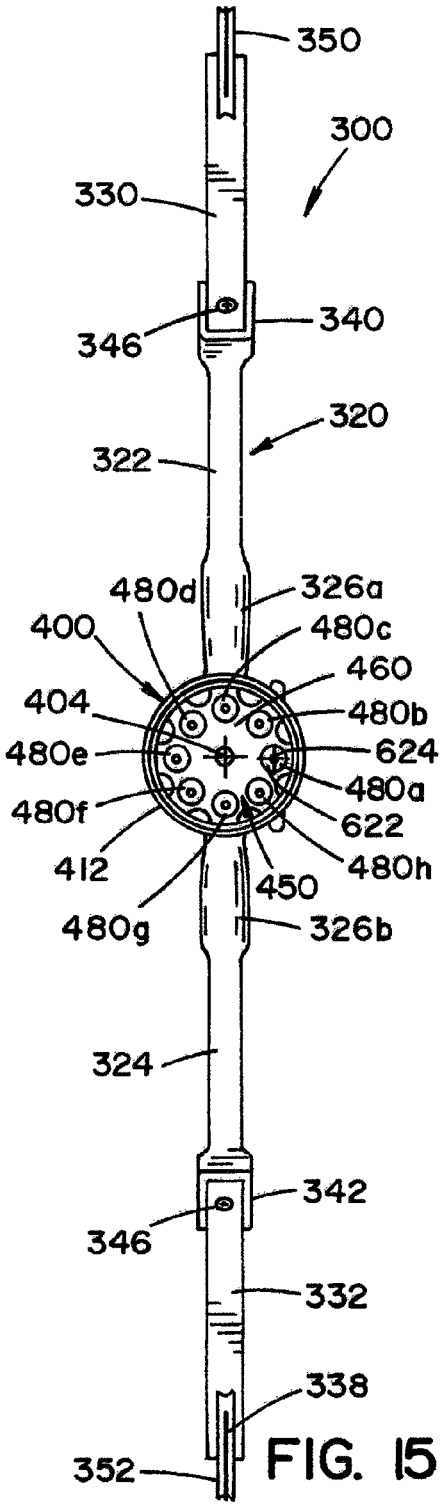
FIG. 15 is a front elevational view of the bow shown in FIG. 11.
Figure 16:
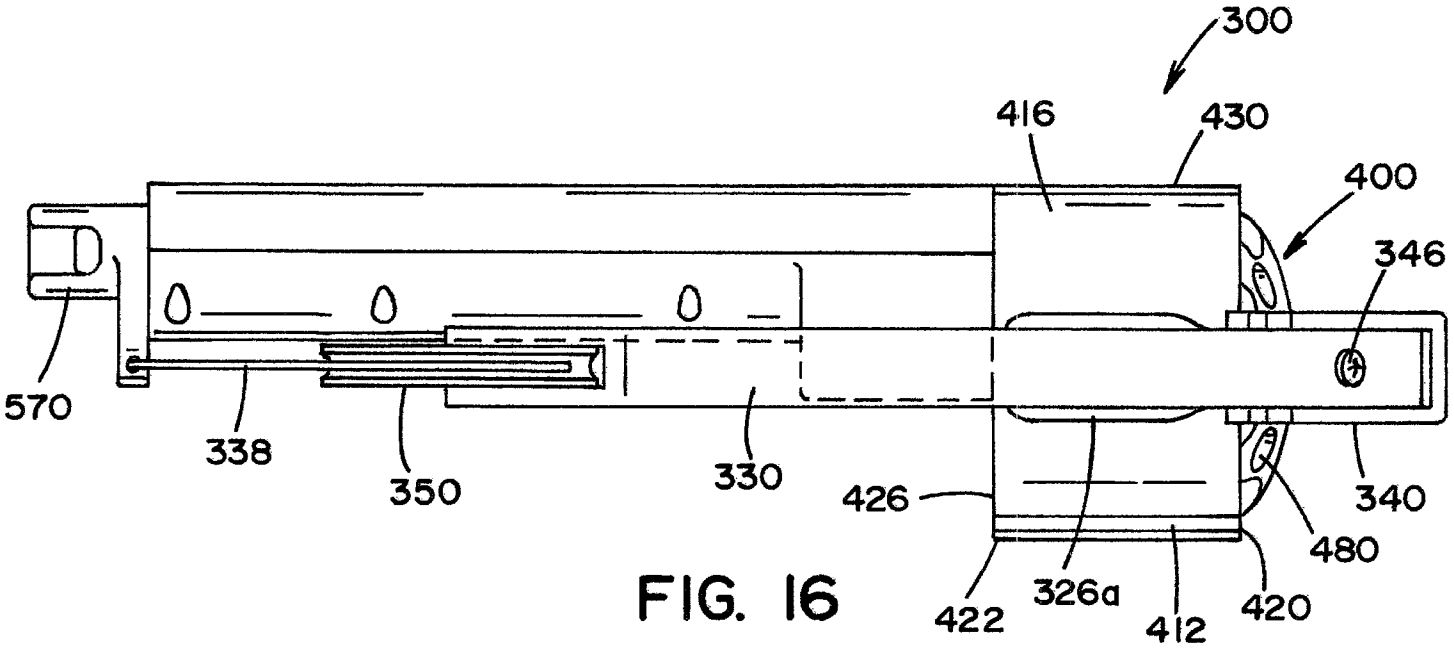
FIG. 16 is a top view of the bow shown in FIG. 11.
Figure 17:
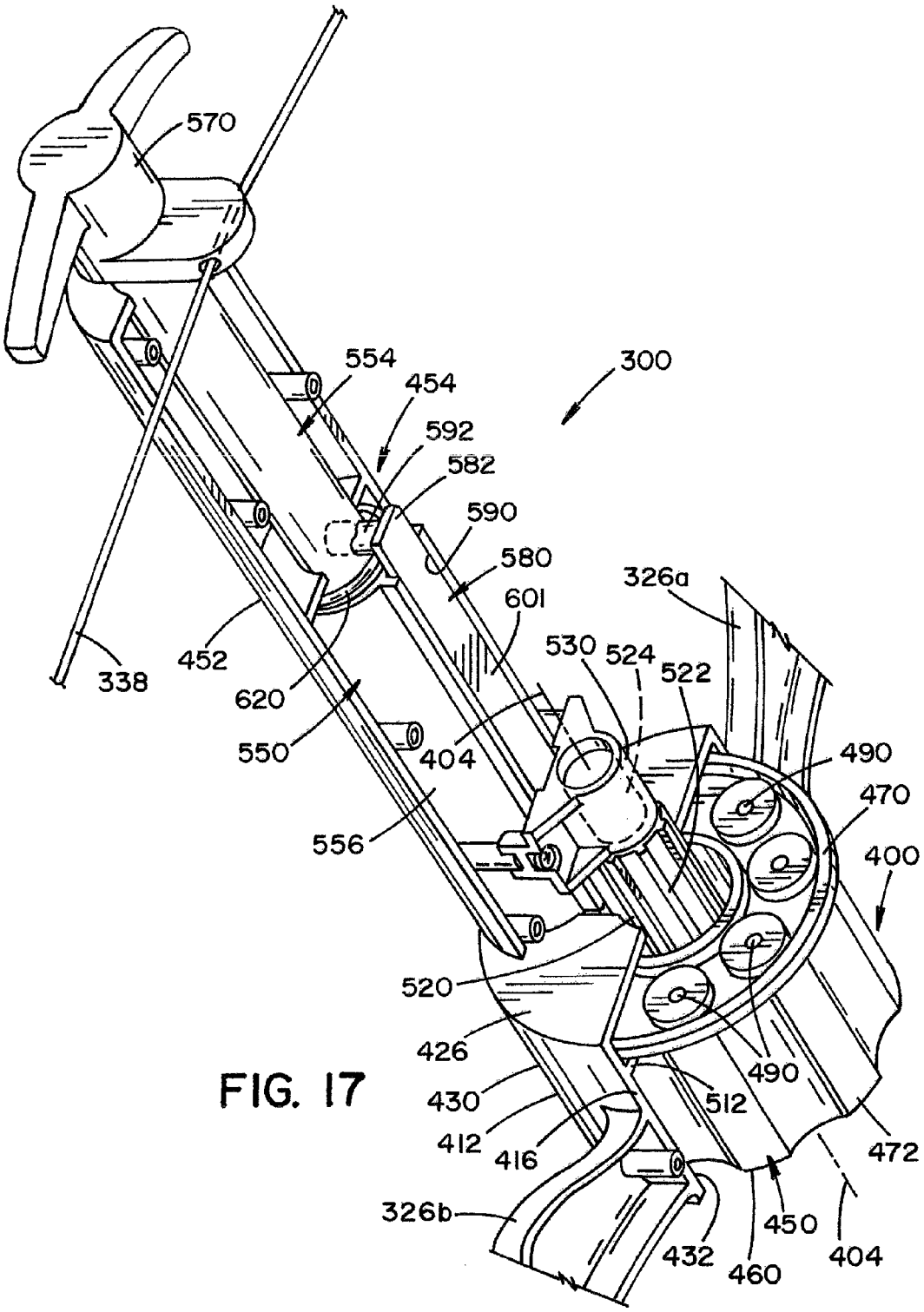
FIG. 17 is an enlarged back side perspective view of the firing system for the bow shown in FIG. 11 partially disassembled.
Figure 18:
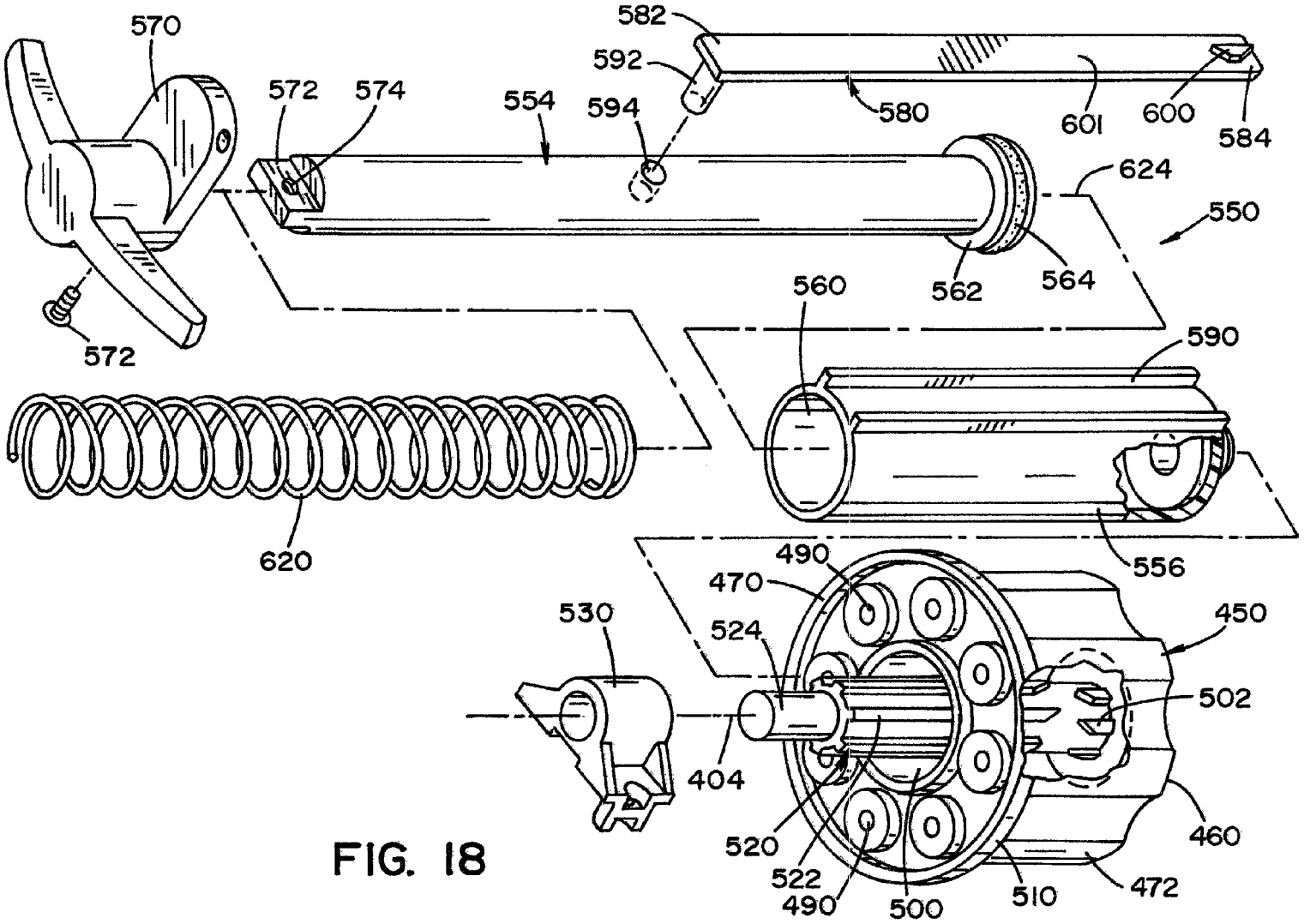
FIG. 18 is an exploded and enlarged back side perspective view of the firing system for the bow shown in FIG. 11 partially sectioned.
Figure 19:
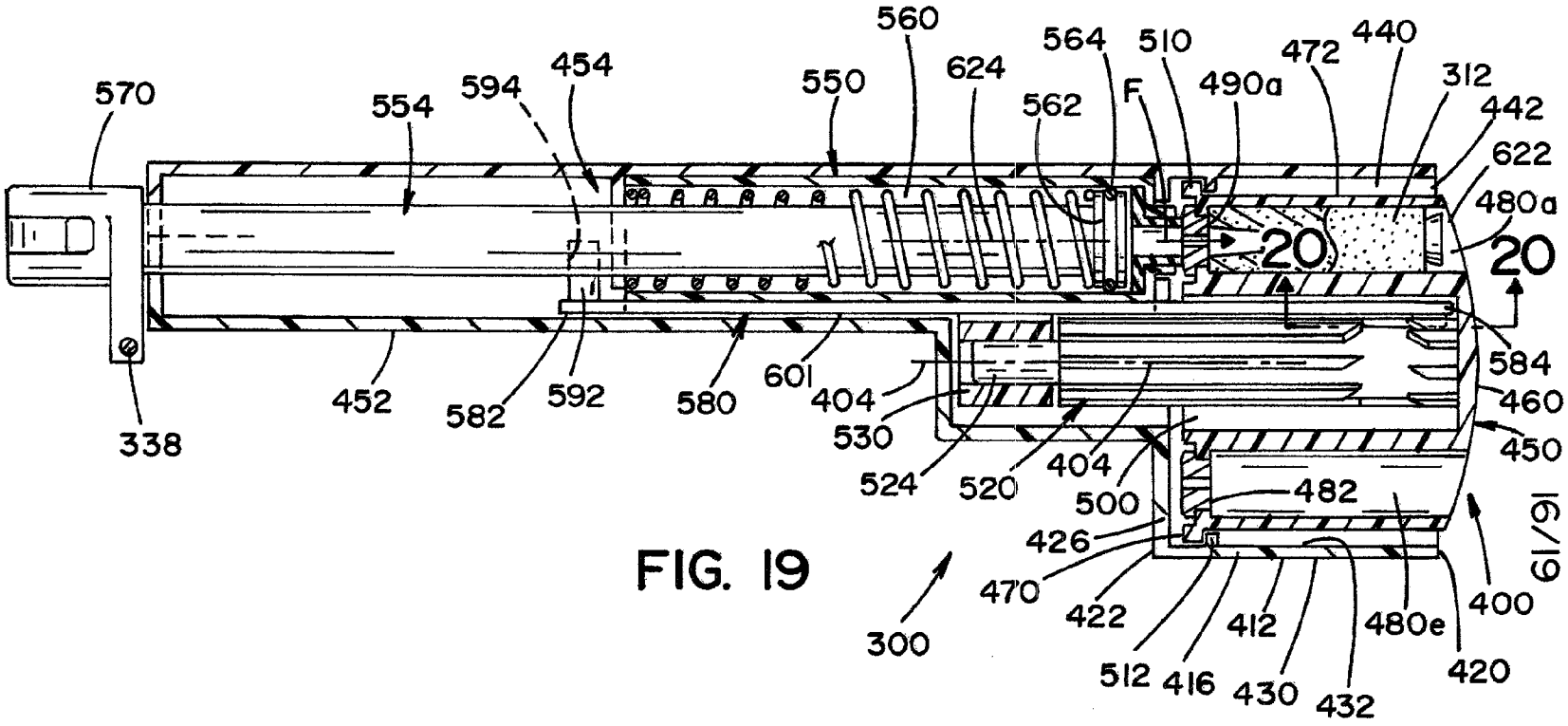
FIG. 19 is a sectional taken along lines 19-19 in FIG. 17.

Referring now to the drawings wherein the showings are for the purpose of illustrating preferred and alternative embodiments of the invention only and not for the purpose of limiting the same, FIGS. 1-10 show a bow 10 that is shown to shoot a projectile 12 that is formed like a traditional arrow, but neither this set of embodiments nor any other embodiments of this application are to be limited to the particular bow and/or projectiles shown in that these are to be considered examples only. In greater detail, projectile 12 includes a head 14, a shaft 15 and a nock 16. While not shown, projectile 12 could further include fletching.

Bow 10 can have a wide range of structural configuration without detracting from the invention of this application. Illustrated is a bow that is formed like a traditional compound bow that includes a bow riser 20. Bow riser 20 is essentially a generally rigid structure that can have a wide range of configuration wherein the overall look of the riser does not provide a function, but merely provides a structure for the overall function of the bow and the invention of this application. Accordingly, it is to be understood that the shape of the riser, except which will be discussed more below, is also to be treated as an example only. Bow riser 20 can include an upper riser portion 22 and a lower riser portion 24 and one or both of the riser portions can include a hand grip 26. Bow 10 can further include an upper limb arrangement or assembly 30 and a lower limb arrangements or assembly 32 connected to the riser. The upper and lower limb assemblies join a bow string 34 to bow 10. Limbs 30 and 32 can be a part off the riser as with traditional long bows or can be separate flexible members attached to a more rigid riser. In the example shown, limbs 30 and 32 are separate and can provide the stored energy to propel projectile 12, but this is not required. In this respect, riser 20 can be flexible, as with a traditional long bow, and provide the stored energy to propel the projectile. In other embodiments, a separate force assisting mechanism to at least in part produce the energy to propel the projectile is provided. As is noted above, the invention of this application can be utilized with a wide range of bow designs wherein the invention of this application is not to be limited to the examples shown. Riser 20 can include upper and lower limb pockets 40 and 42, respectively, which can be used to secure the limbs to the riser. In the embodiments shown, this can further include fasteners 46 to maintain the interengagement therebetween.

Yet further, bow 10 can include string supports 50 and 52 that can utilize any technology known in the art. In this respect, supports 50 and/or 52 can be an opening in the limb assembly, a mounted arrangement on the limb assembly to support the string, a cam pulley (such as those used on compound bows), an idler wheel or pulley, string supports that are intended to look like cams or idler pulleys, and/or the like.

The invention of this application relates to a drum assembly 100 that is secured relative to bow 10. In the embodiment shown, drum assembly 100 is secured relative to bow riser 20 and rotates about a drum axis 104. More particularly, bow 10 can include a drum housing 112 that is formed into or attached to riser 20. In the embodiment shown, drum housing 112 is formed into riser 20 and is positioned between upper riser portion 22 and lower riser portion 24. Housing 112 includes an outer housing wall 116 that extends between a front housing extent 120 and a rear housing extent 122. Further housing wall 116 includes an outer surface 130 and an inner surface 132 wherein inner surface 132 can at least partially form an inner drum region 140. Drum wall 116 can further include an actuation or lever opening 142 that will be discussed more below.

Drum assembly 100 further includes an inner rotatable drum 150 that can be formed from one or more components. In the embodiment shown in this example, drum 150 includes a front drum portion 160 and a rear drum portion 170, which can be used to help secure drum assembly 150 within inner drum region 140, which will be discussed more below. Front and rear drum portions 160 and 170, respectively, are joined to one another by way of a drum axil 180 wherein, as shown, the drum axil can be formed or molded into one of the drum portions. In the embodiments shown, drum axil 180 includes a front axil portion 182 and a rear axil portion 184. Front portion 160 can include a threaded opening 162 and rear portion 170 can include a through hole 172 to allow a fastener 174 to selectively secure portions 160 and 170 relative to one another. Further, front portion 160 can include a key 164 in front axil portion 182 and rear axil portion 184 can include a key pocket 176. Drum axil 180 can further include a cam arrangement 185 that can include a plurality of cam surfaces 186 and corresponding locking ledges 187 and these surfaces and/or ledge could be on either drum portion or both. The number of cam surfaces 186 and locking ledges correspond to the number of projectiles to be held in drum 150. As is shown, there are three, which are circumferentially spaced about drum axis 104 by 120 degrees. Inner drum region 140 can further include an inwardly facing biasing tab 188 that can be used to maintain the rotatable drum 150 in proper alignment within region 140 and allow for relative rotation therein. In this respect, front and/or rear drum portions can include a guide ledge 189 and tab 188 can run along ledge 189 as drum 150 rotates within inner drum region 140. Drum assembly 100 can further include a manually operable indexing lever 190 that can be used by the operator to index the projectiles into the firing position, which will be discussed more below. Indexing lever 190 includes a lever arm 192 and an axil sleeve 194 wherein axil sleeve 194 is configured to receive drum axil 180 to provide the selective rotation of the drum. Lever 190 extends out lever opening 142 and the engagement between lever 190 and lever opening 142 can maintain the drum within the drum housing. Lever 190 further includes a ratcheting pawl 195 with a pawl lock 196.

Drum assembly 100 further includes three alignment detents 197*a*, 197*b* and 197*c* fixed relative to drum 150 corresponding to each of the rotational firing positions of the bow. Alignment detents 197 work in combination with biasing tab 188 to align the drum within the housing. In the embodiments shown, there are three detents, which will be discussed more below. Again, three are shown as an example wherein three have bee found to be preferred, but not required. This, in combination with indexing lever creates a ratcheting action for the rotation of the drum about the drum axis and which aligns the drum such that one of the projectiles is in the firing position and the remaining projectiles are spaced from the firing position, which will be discussed more below.

When in the assemble condition, inner rotatable drum forms a plurality of projectile openings 200 that are configured to support a corresponding plurality of projectiles 12. These can be formed in both front and rear drum portions 160 and 170. In the embodiment shown in this example, drum 150 includes three projectile openings or supports 200*a*, 200*b* and 200*c* wherein three projectiles 12*a*, 12*b* and 12*c* can be positioned in bow 10 at one time. Further supports can include projectile bushings 201 so that openings 200 are form fitting to help at least partially maintain the projectiles in a shooting alignment, and to prevent the projectiles from falling out of the bow. In the embodiments shown, each of the openings includes two pairs of bushings, namely, a front pair 210 and a rear pair 212. However, of these three supports, only one of them is in a firing position 202 and the other two are spaced from the firing position. In the views shown, projectile support 200*a* is in the firing position and supports 200*b* and 200*c* are sufficiently spaced from the firing position to prevent interference with the firing of projectile 12*a*. In addition, drum 150 can include forward projections 220*a-c* and rearward projections 222*a-c* that can allow bushings 210 and 212 to be further spaced from one another to better support the projectiles. In this arrangement, detents 197 can extend into the projections. Yet further, drum 150 can include one or more bearing ribs 224 that can help align the drum within the housing and allow it to track better within the housing.

In operation, bow 10 can be loaded with three projectiles 12*a*, 12*b* and 12*c*. In order to allow the projectiles to be loaded from the front of bow 10, and if projectiles have fletching, the fletching can have a special configuration. In this respect, fletching can be a solid sheet of material to allow passage through the projectile supports. In that projectiles 12*a*, 12*b*, 12*c* extend rearwardly out of the drum, the user can position nock 16 of projectile 12*a* onto bow string 34 and draw the bow string back to a full draw condition to shoot the projectile like a traditional bow. Since projectiles 12*b* and 12*c* are clear of the firing position, they do not interfere with the aiming of the bow or the firing of projectile 12*a*. Further, bow 10 can include a sight 230 to help aim the bow. After projectile 12*a* is fired, the user can then actuate lever 190 to quickly rotate drum 150 about drum axis 104 and move projectile support 200*b* and corresponding projectile 12*b* into firing position 202. In greater detail, as lever 190 is moved downwardly, or clockwise from the rear view, about axis 104, pawl lock 196 engages locking ledge 187 thereby rotating drum 150 about drum axis 104 (see FIG. 10). This continues until biasing tab 188 engages alignment detent 197*b* such that drum 150 is aligned with opening 200*b* in firing position 202. Then, lever 190 can be moved upwardly, or counterclockwise from the rear view, wherein pawl 196 rides up cam surface 186 until it locks in the next locking ledge. Nock 16 of projectile 12*b* can then be positioned on the bow string to shoot projectile 12*b*. In view of the engagement between tab 188 and detent 197*b*, the projectile opening is automatically in alignment with the shooting position without separate manipulation and maintained therein. Then, the user can draw back nock 16 of projectile 12*b* and bow string 34 to a full draw condition to shoot projectile 12*b*. Since projectile 12*c* is still clear of the firing position, it does not interfere with the aiming of the bow or the firing of projectile 12*b*. After projectile 12*b* is fired, the user can then actuate lever 190 to quickly rotate drum 150 about drum axis 104 and move projectile support 200*c* and corresponding projectile 12*c* into firing position 202. As a result, more than one projectile can be loaded and quickly fired is succession. As can be appreciated, any number of projectiles could be supported by the drum. However, it has been found that three projectile supports works well for the arrow like projectiles as is shown in this set of embodiments.

With reference to FIGS. 11-20F shown is a bow 300 that is shown to shoot a different style of projectile 312 that is formed like a foam dart. Again, neither this set of embodiments nor any other embodiments of this application is to be limited to the particular projectiles shown in that these are to be considered examples only. However, what should be noted is that the number of projectiles in this embodiment is increased in view of the different size of these projectiles. In this respect, bow 300 is configured to support and fire eight projectiles 312, which will be discussed more below.

Bow 300 also can have a wide range of structural configuration without detracting from the invention of this application. Illustrated is a bow that is formed like a traditional compound bow that includes a bow riser 320. In the embodiments shown, bow riser 320 is essentially a generally rigid structure that can have a wide range of configuration wherein the overall look of the riser does not provide a function, but merely provides a structure for the overall function of the bow and the invention of this application. Accordingly, it is to be understood that the shape of the riser, except which will be discussed more below, is also to be treated as an example only. Bow riser 320 can include an upper riser portion 322 and a lower riser portion 324 and one or both of the riser portions can include a hand grip 326. This particular bow includes a unique riser design that is configured for both right and left handed users wherein riser 320 includes two hand grips 326*a* and 326*b*.

Bow 300 can further include an upper limb assembly 330 and a lower limb assembly 332 connected to the riser. The upper and lower limb assemblies join a bow string 338 to bow 300. Limbs 330 and 332 can provide the stored energy to propel projectile 312, but this is not required. As will be discussed more below, this set of embodiments further includes a force assisting mechanism. As with the other embodiments, riser 320 could be flexible, as with a traditional long bow, and provide the stored energy to propel the projectile. Again, the invention of this application can be utilized with a wide range of bow designs wherein the invention of this application is not to be limited to the examples shown. Riser 320 can include upper and lower limb pockets 340 and 342, respectively, which can be used to secure the limbs to the riser. Further, bow 300 can further include fasteners 346 to maintain the interengagement therebetween. However, it should be noted that the limbs of any embodiment of this application could be co-molded with the riser, which is a greater possibility if the bow includes the force assisting mechanism, which will be discussed more below.

As with the embodiments above, bow 300 can include string supports 350 and 352 that can utilize any technology known in the art. In this respect, supports 350 and/or 352 can be an opening in the limb assembly, a mounted arrangement on the limb assembly to support the string, a cam pulley (such as those used on compound bows), an idler wheel or pulley, string supports that are intended to look like cams or idler pulleys, and/or the like.

Again, the invention of this application relates to a drum assembly 400 that allows multiple projectiles to be maintained relative to the bow and quickly moved into a firing position. In this respect, bow 300 includes drum assembly 400 that is secured relative to bow 300. In the embodiment shown, drum assembly 400 is secured relative to bow riser 320. More particularly, bow 300 can include a drum housing 412 that can be formed into or attached to riser 320. In the embodiment shown, drum housing 412 is formed into riser 320 and is positioned between upper riser portion 322 and lower riser portion 324, in particular between handles or grips 326*a* and 326*b*. Housing 412 includes an outer housing wall 416 that extends between a front housing extent 420 and a rear housing extent 422. Further housing wall 416 can include a rear housing wall 426. Housing wall 416 further includes an outer surface 430 and an inner surface 432 wherein inner surface 432 can at least partially form an inner drum region 440. Drum housing 412 has a forward opening 442 shaped to receive a rotatable drum 450 that is configured to selectively rotate about a drum axis 404. Housing 412 further includes a rearward extending member 452 that is configured to support a force assisting mechanism 454 both of which will be discussed in greater detail below. Member 452 can extend rearwardly from rear housing wall 426.

Drum 450 includes a front face 460 and a rear face 470 and can include a side walls 472 between the front and rear faces. All of these walls and faces do not need to be a single and/or unified feature wherein each can includes a wide range of shapes and/or configurations without detracting from the invention of this application, and as is shown. Further, this side wall does not need to be perfectly cylindrical, as is shown in the drawings. Front face 460 includes a plurality of projectile openings 480*a*-480*h* that are shaped to receive up to eight projectiles 312. In the embodiments shown, and as will be discussed more below, the projectile openings are shaped to receive the projectiles in a generally air tight arrangement wherein air pressure is used in this embodiment to propel the projectiles. Any form of air delivery system known in the art could be used to direct the air into contact with projectiles 312 and to prevent unwanted objects from being launched without detracting from the invention of this application. In that these are known in the art, they will not be discussed in greater detail herein in the interest of brevity. Each of projectile openings 480 extends rearwardly toward drum rear face 470, but generally stops short of the rear face at an opening rear extent 482. And, each of the projectile openings includes an air inlet 490 that extends through rear face 470 and rear extents 482 to allow an incoming flow of air F to propel the projectile, which will be discussed more below.

Drum 450 further includes a rearwardly facing geared opening 500 that includes inwardly facing drum teeth, which will be discussed more below. And, drum 450 can include a guide flange 510 that can engage an inner drum surface flange 512 to help control the relative rotation of drum 450 about drum axis 404. This flange arrangement can also be configured to secure the drum within the drum housing.

Drum assembly 400 further includes a rotation gear extension 520 having radially outwardly facing rear gear teeth 522 radially outwardly facing gear forward teeth 502 that are circumferentially offset from rear gear teeth 522, which will be discussed more below. Front teeth 502 and rear teeth 522 together provide the selective rotation of drum 450 about drum axis 404, which will be discussed more below. Gear extension 520 includes a bearing region 524 shaped to be received by a guide 530 that is fixed relative to rearward extending member 452 to better support drum 450 and gear extension 520 as they rotate together about axis 404. Further, drum 450 and extension 520 can be manufactured as assembled components by any method known in the manufacturing arts. In operation, the rotation of drum 450 is based on the interaction between rear gear teeth 522 and front teeth 502, which will be discussed more below.

As noted above, bow 300 includes force assisting mechanism 454, which in this example is a pressurized air system positioned in rearward extending member 452. Further, the force assisting mechanism can also be utilized to rotate drum 450. In greater detail, force assisting mechanism 454 includes an air cylinder 550 that includes a cylinder rod 554, a cylinder tube 556 forming an air chamber 560. Rod 554 can include a rod head 562 having a sealing O-ring 564. Air cylinder 550 can be in general alignment with the shooting position and can be joined to bow string 338 to provide a realistic feel when bow 300 is fired. In this respect, cylinder rod 554 can include a string connector 570 joined to a distal end 572 of rod 554. String connector can include a wide range of configurations without detracting from the invention of this application including, but not limited to, the shown finger tabs and string connector. End 572 can include a fastening opening 574 wherein a fastener 576 can operably join connector 570 to rod 554. As a result, rod 554 is pulled back when bow string 338 and/or connector 570 is drawn back to a firing condition or visa versa. Air cylinder 550 internally can be any air cylinder known in the art wherein the inner configuration is not being discussed in detail in the interest of brevity.

Force assisting mechanism 454 can further include an actuation bar 580 that extends from a reward end 582 to a forward end 584. Bar 580 can be supported for relative movement by an outer track 590 in an external portion of air cylinder 550. Rearward end 582 can be joined relative to rod 554 by a connector 592 that can be fixed relative to a rod opening 594 such that bar 580 moves with the movement of the rod when the bow string is drawn back. Forward end 584 includes a gear engagement protuberance 600 that can extend from an inner face 601 of bar 580. In the embodiments shown, protuberance 600 can have a generally triangular shape or can be trapezoidal as is shown. Protuberance 600 includes a base edge 602 with an opposite top edge 604 that is shorter than base edge 602. Protuberance further includes a forward angled edge 606 and a rearward angled edge 608. Protuberance acts to rotate drum 450 by way of gears 522 and 502 about drum axis 404 each time rod 554 is cycled, which will be described in greater detail below. In order to provide the force assistance, force assisting mechanism 454 can further include an internal spring 620. As a result, bow 300 can fire a projectile even without the aid of the bow string. However, in the embodiments shown, the bow string is connected to mechanism 454 for a more realistic feel.

As noted above, drum 450 incudes a plurality of projectile openings 480*a*-480*h* that are shaped to receive up to eight projectiles 312. In the embodiment shown in this example, drum 450 supports eight projectiles, but could support a different number without detracting from the invention of this application. However, of these eight supports, only one of them is in a firing position 622 positioned along a firing axis 624 and the other seven are spaced from the firing position and firing axis. In the views shown, projectile support or opening 480*a* is in firing position 622 and supports 480*b*-480*h* are sufficiently spaced from firing position 622 to prevent interference with the firing of projectile 312 in firing position 622.

In operation, bow 300 can be loaded with eight projectiles 312 through front face 460. Then, in this embodiment, the user does not need to engage the projectile 312 onto bow string 338, but merely draws the bow string or string connector 570 back to fire the projectile. As the bow string/connector is drawn back, rod 554 is pulled rearwardly and draws air into cylinder 550. Once the bow string is released, spring 620 urges the rod forwardly such that pressurized air is directed toward drum 450 and into support 480*a* by way of opening 490 thereby launching projectile 312 from the bow. The air flow is limited to the chamber in the firing position wherein the remaining projectiles are not affected.

Figure 20A:
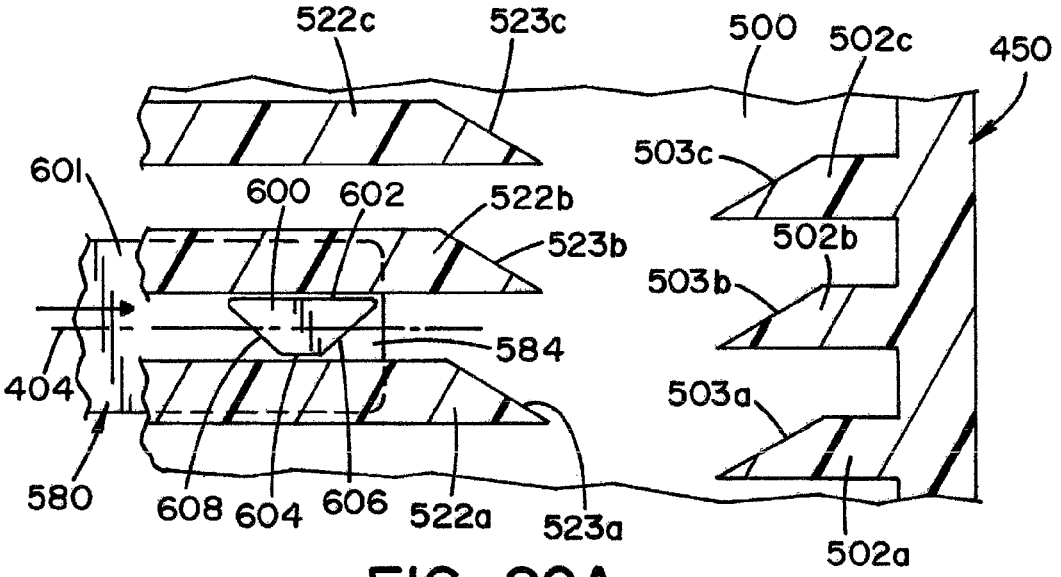
FIG. 20A is an enlarged sectional view taken along lines 20-20 in FIG. 19 wherein an actuating bar is in a rear position.
Figure 20B:
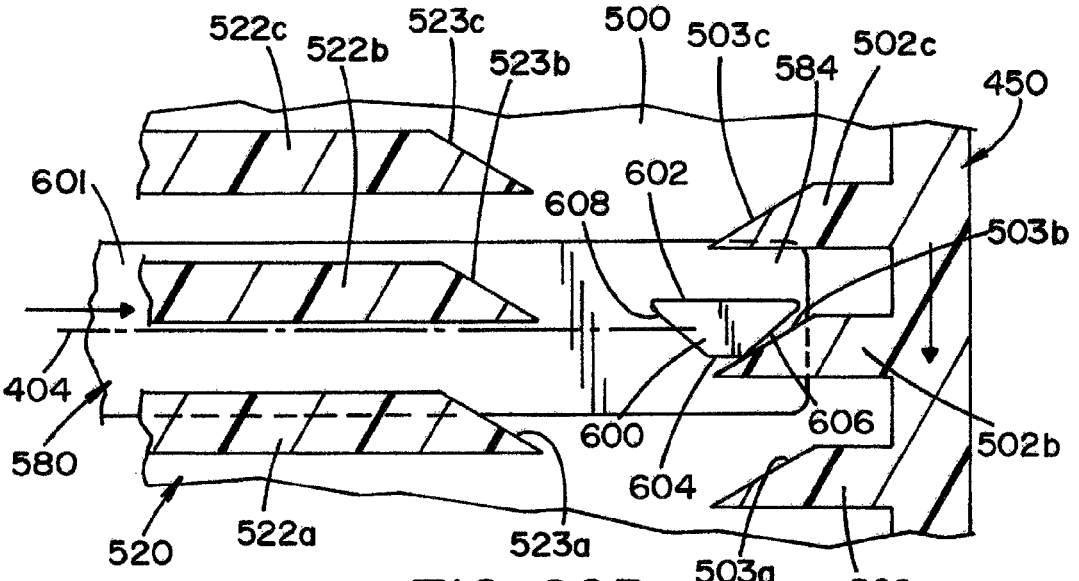
FIG. 20B is an enlarged sectional view taken along lines 20-20 in FIG. 19 wherein the actuating bar is being pushed forward toward a forward position.
Figure 20C:
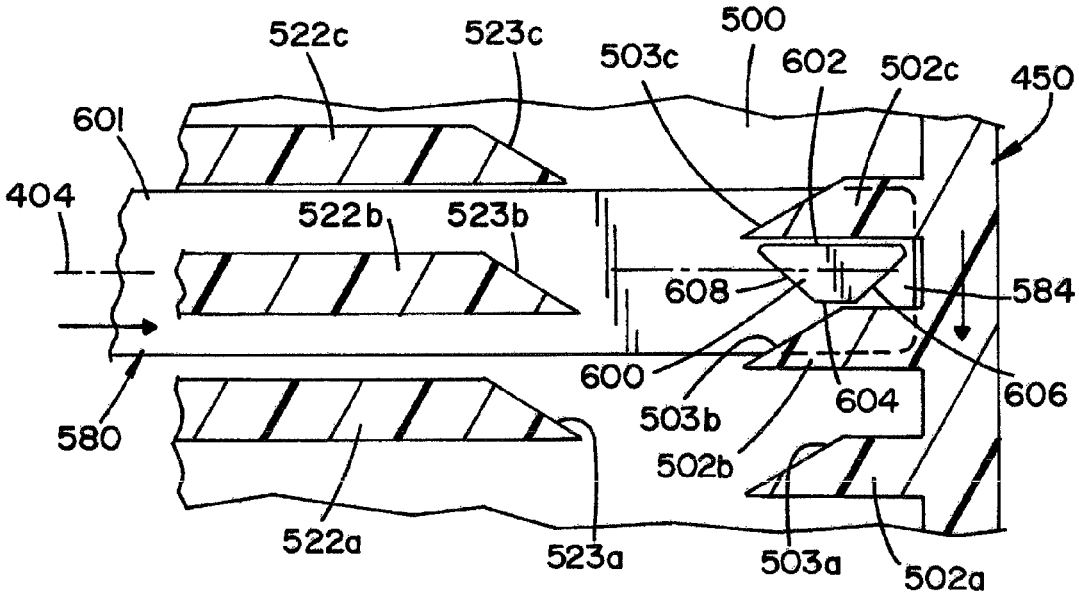
FIG. 20C is an enlarged sectional view taken along lines 20-20 in FIG. 19 wherein the actuating bar is in the forward position.
Figure 20D:
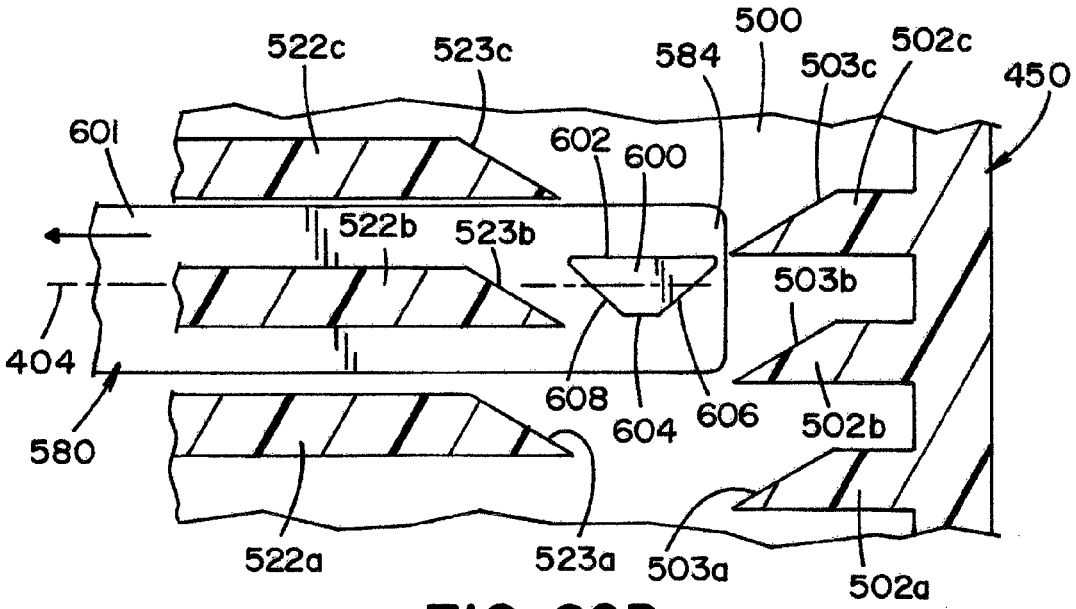
FIG. 20D is an enlarged sectional view taken along lines 20-20 in FIG. 19 wherein the actuating bar is being pulled rearward toward the rear position.
Figure 20E:
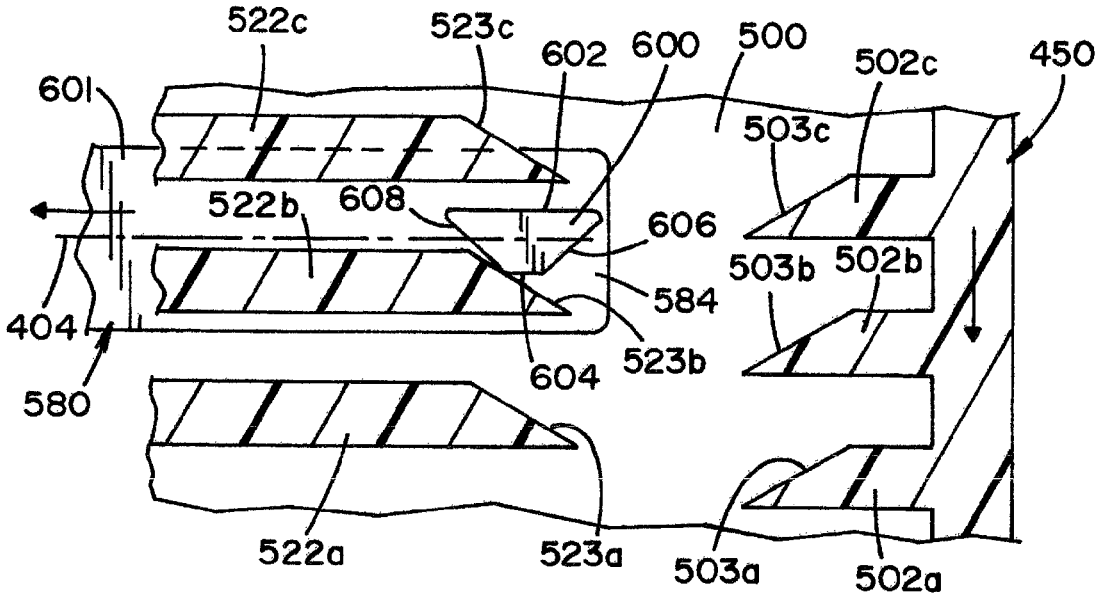
FIG. 20E is an enlarged sectional view taken along lines 20-20 in FIG. 19 wherein the actuating bar is being pulled rearward further toward the rear position; and, FIG. 20F is an enlarged sectional view taken along lines 20-20 in FIG. 19 wherein the actuating bar is returned to the rear position.
Figure 20F:
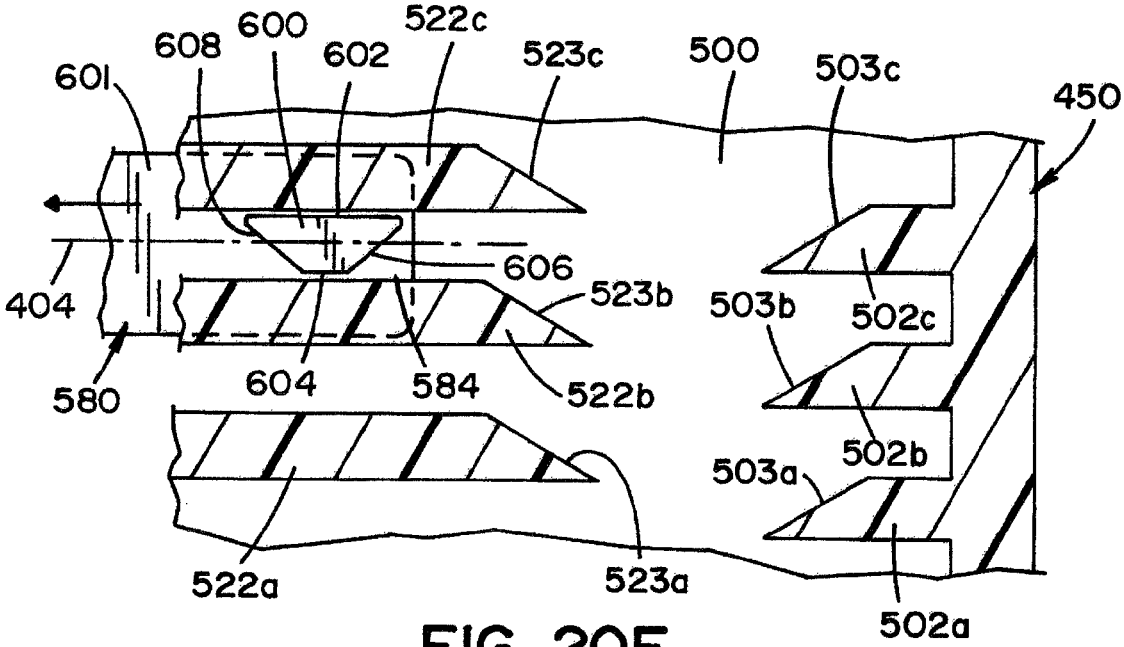

With special reference to FIGS. 20A-F, the movement of rod 554 also moves actuation bar 580 that, as discussed above, rotates drum 450 such that each cycle of the bow string moves drum to the next projectile support. After projectile 312 is fired, the user merely pulls the string back a second time to fire a second projectile and this can be continued until all projectiles are launched. As a result, more than one projectile can be loaded and quickly fired is succession. In greater detail, FIGS. 20A-20F generally show the interaction between actuation rod 580, rear teeth 522 and forward teeth 502 of drum 450. FIG. 20A shows protuberance 600 at or near a rear position and moving forward wherein protuberance 600 is between rear teeth 522*a* and 522*b*. In more detail, protuberance edge 604 faces tooth 522*a* and protuberance edge 602 faces tooth 522*b*. With reference to FIG. 20B, as actuating bar 580 moves forwardly toward a forward position, protuberance 600 is released by rear teeth 522*a* and 522*b* and engages forward tooth 502*b*. During engagement, protuberance edge 606 rides up a lead in edge 503*b* tooth 502*b* to partially rotate drum 450 about drum axis 404 down in this view or clockwise when looking at the bow from the front. As actuating bar 580 and protuberance 600 reach the forward position shown in FIG. 20C, protuberance 600 is in a forward position and is positioned between forward teeth 502*b* and 502*c* such that protuberance edge 604 faces tooth 502*b* and protuberance edge 602 faces tooth 502*c* wherein drum 450 has been partially rotated toward the next projectile opening. Then, actuating bar 580 and protuberance 600 are moved rearwardly to fire the next projectile, as is shown in FIG. 20D, protuberance 600 moves rearwardly toward rear tooth 522*b* and is released by drum teeth 502*b* and 502*c*. As it moves further rearwardly, as is shown in FIG. 20E, protuberance 600 engages rear tooth 522*b* and protuberance edge 608 engages and rides up a lead in edge 523*b* to further rotate drum 450 about axis 404. In FIG. 20F, protuberance 600 is shown at or near the rear position again wherein protuberance 600 is now positioned between rear teeth 522*b* and 522*c* such that protuberance edge 604 faces tooth 522*b* and protuberance edge 602 faces tooth 522*c*. At this time, drum 450 is now fully cycled to the next projectile opening 480. In this example, drum 450 is cycled to projectile opening 480*b*.

As can be appreciated, any number of projectiles could be supported by the drum of this set of embodiments too. However, it has been found that eight projectile supports works well for foam projectiles.

While considerable emphasis has been placed on the preferred embodiments of the invention illustrated and described herein, it will be appreciated that other embodiments, and equivalences thereof, can be made and that many changes can be made in the preferred embodiments without departing from the principles of the invention. Furthermore, the embodiments described above can be combined to form yet other embodiments of the invention of this application. Accordingly, it is to be distinctly understood that the foregoing descriptive matter is to be interpreted merely as illustrative of the invention and not as a limitation.

It is claimed:

1. An archery bow configured to allow multiple projectiles to be selectively fired by the archery bow, the bow comprising a bow riser extending between a front and a rear with a first end and a second end, the bow further including a first limb arrangement fixed relative to the first end and a second limb arrangement fixed relative to the second end wherein a bow string is joined between the first and second limb arrangements rearwardly of the riser, the bow further including a drum housing and a selectively rotatable drum rotatably secured relative to the drum housing, the selectively rotatable drum being rotatable about a drum axis and having a plurality of projectile openings circumferentially spaced about the drum axis, each of the plurality of projectile openings having a front extent and said each opening of the plurality of openings being shaped to receive an associated projectile wherein a plurality of associated projectiles can be secured in the selectively rotatable drum at one time, one of the plurality of projectile openings being in a firing position and supporting an associated projectile to be fired by the bow and a remaining portion of the projectile openings being spaced from the firing position such that a remaining portion of the associated plurality of projectiles are spaced from the firing position to reduce interference with the associated projectile to be fired, the selectively rotatable drum having a rotation mechanism to selectively rotate each of the plurality of openings into the firing position individually, the bow further including a shooting force mechanism to selectively propel the associated projectile to be fired.

2. The archery bow of claim 1 wherein the bow riser is rigid and the first and second limb arrangements are flexible and operably connected to the bow riser, the first and second limb arrangements providing at least part of the shooting force, the drum housing being a portion of the bow riser.

3. The archery bow of claim 1 wherein the shooting forcing of the shooting force mechanism is produced by at least one of the bow riser, the bow string and the first and second limb arrangements.

4. The archery bow of claim 3 wherein the associated projectiles have a configuration at least similar to a traditional arrow that includes a head, a shaft and a nock, the bow configured such that the bow string engages the associated nock of the associated projectile to be fired and the shooting force is transmitted to the associated projectile to be fired by way of the bow string, the projectile openings being through openings wherein the associated projectiles extend from both a front side and a rear side of the drum to avow the associated nock of the projectile to be fired to engage the bow string, only the one of the plurality of projectile openings in the firing position being in general alignment with the bow string.

5. The archery bow of claim 4 wherein the plurality of projectile openings circumferentially spaced about the drum axis includes at least a first projectile opening, a second projectile opening and a third projectile opening, the one of the plurality of projectile openings being in the firing position being the first projectile opening, the rotation mechanism including a manually operable indexing lever wherein a single actuation of the manually operable indexing lever indexes the drum about the drum axis such that the second projectile opening moves into the firing position.

6. The archery bow of claim 5 wherein the rotation mechanism further includes a ratcheting pawl and a one way teeth arrangement to restrict the rotation of the drum about the drum axis to a single rotational direction, the rotation mechanism further including a biasing tab to align the drum about the drum axis in the firing position.

7. The archery bow of claim 6 wherein the biasing tab extends inwardly from the drum housing and the drum includes a plurality of alignment detents corresponding with the plurality of projectile openings, the manually operable indexing lever including the ratcheting pawl.

8. The archery bow of claim 7 wherein the drum includes a front drum portion and a rear drum portion, the drum further including a drum axil extending between the front and rear drum portions and being fixed relative thereto, the one way teeth arrangement including drum axil having a plurality of cam surfaces and corresponding locking ledges that correspond to the plurality of projectile openings, the ratcheting pawl configured to follow the cam surfaces and engage one of the locking ledges to rotate the drum about the drum axis.

9. The archery bow of claim 1 wherein said each of the plurality of openings further includes a rear extent and a rear air net opening, the rear net opening for the one of the plurality of projectile openings being in the firing position being in fluid connection with the flow of the pressurized air and the rear net opening in the remaining portion of the projectile openings being separated from the flow of the pressurized air.

10. The archery bow of claim 1 wherein the drum housing is formed by an outer housing wall that extends between a front housing extent and a rear housing extent, the outer housing wall having an inner surface and a rear housing wall that at least partially defines an inner drum region, the inner drum being shaped to receive the selectively rotatable drum.

11. The archery bow of claim 10 wherein the drum housing further includes a rearward extending member that includes the force assisting mechanism, the rearward extending member being in general alignment with the firing position.

12. The archery bow of claim 1 wherein the drum further includes a rearwardly facing geared opening that includes a rotation gear extension that includes a set of rear radially outwardly facing teeth and a set of front radially outwardly facing teeth, the set of front teeth being circumferentially offset from the rear teeth, the front and rear teeth providing the selective rotation of the drum about drum axis.

13. The archery bow of claim 12 wherein the force assisting mechanism further includes an actuation bar that extends from a reward end to a forward end, the actuation bar being fixed relative to the cylinder rod such that the actuation bar moves with the cylinder rod, the actuation bar including a gear engagement protuberance at least near the forward end, the gear engagement protuberance interengaging with the front and rear sets of teeth to rotate the drum about the drum axis each time the cylinder rod is cycled, so that the drum is actuated toward a next in line projectile opening.

14. The archery bow of claim 13 wherein the cycle include a forward actuation of the actuation bar and a reward actuation of the actuation bar wherein the rearward action of the rod produce a first portion of the actuation toward the next in line projectile opening and the forward action of the rod produce a second portion of the actuation toward the next in line projectile opening.

15. The archery bow of claim 14 wherein the front and rear sets of teeth to rotate the drum are spaced from one another and the front set include front lead in edges and the rear set include rear lead in edges, the front and rear lead in edges generally facing one another and being offset from one another, the gear engagement protuberance having a forward angled edge a rearward angled edge, the rearward angled edge configured to engage and ride along one of rear lead in edges for the first portion of the actuation toward the next in line projectile opening and the forward angled edge configured to engage and ride along one of front lead in edges for the second portion of the actuation toward the next in line projectile opening.

16. The archery bow of claim 15 wherein the aft chamber includes a cylinder tube, the cylinder tube including an outer track configured to guide the actuation bar, the actuation bar having a first side engaging the cylinder tube and a second side opposite of the first side, the second side including the protuberance.

17. The archery bow of claim 13 wherein the air chamber includes a cylinder tube, the cylinder tube including an outer track configured to guide the actuation bar, the actuation bar having a first side engaging the cylinder tube and a second side opposite of the first side, the second side including the protuberance.

18. The archery bow of claim 1 wherein the bow riser has a first riser portion on a first side of the drum and a second riser portion on a second side of the drum, both the first and second riser portions including a hand or grip to allow the bow to be held by an associated user's left or right hand.

19. The archery bow of claim 1 wherein plurality of projectile openings is at least six projectile openings.

* * * * *

UNITED STATES PATENT AND TRADEMARK OFFICE

CERTIFICATE OF CORRECTION

PATENT NO. : 9,341,422 B2
APPLICATION NO. : 14/621862
DATED : May 17, 2016
INVENTOR(S) : Rudy D. Rodich et al.

It is certified that error appears in the above-identified patent and that said Letters Patent is hereby corrected as shown below:

In the claims,

Col. 11, Line 34, Claim 1, the following should be added --, wherein the shooting force mechanism includes an air cylinder that includes a cylinder rod and an air chamber, the shooting force mechanism further including a cylinder spring and the cylinder rod having a distal end fixed relative to the bow string wherein drawing back the bow string urges the cylinder rod of the air cylinder rearwardly and extends the cylinder spring, and releasing the bow string allows at least the cylinder spring to urge the cylinder rod forwardly and producing a flow of pressurized air to propel the one of the plurality of projectile openings in the firing position--.

Col. 11, Line 52, Claim 4, the word "avow" should be --allow--.

Col. 12, Line 21 and 24, Claim 9, in 3 instances the word "net" should be --inlet--.

Col. 13, Line 6, Claim 16, the word "aft" should be --air--.

Signed and Sealed this
Twenty-sixth Day of July, 2016

Michelle K. Lee

Michelle K. Lee
*Director of the United States Patent and Trademark Office*